US008438800B2

(12) United States Patent
McLain et al.

(10) Patent No.: US 8,438,800 B2
(45) Date of Patent: May 14, 2013

(54) SUPPORT STRUCTURES ON ROOFS

(75) Inventors: Michael J. McLain, Green Bay, WI (US); Timothy Pendley, Madera, CA (US)

(73) Assignee: T&M Inventions, LLC, Green Bay, WI (US)

( * ) Notice: Subject to any disclaimer, the term of this patent is extended or adjusted under 35 U.S.C. 154(b) by 44 days.

(21) Appl. No.: 13/065,172

(22) Filed: Mar. 14, 2011

(65) Prior Publication Data

US 2012/0233941 A1 Sep. 20, 2012

(51) Int. Cl.

| | |
|---|---|
| ***E04B 7/18*** | (2006.01) |
| ***E04B 7/02*** | (2006.01) |
| ***E04B 7/04*** | (2006.01) |
| ***E06B 3/26*** | (2006.01) |

(52) U.S. Cl.
USPC ..... 52/200; 52/90.2; 52/91.1; 52/202

(58) Field of Classification Search ..... 52/200, 52/18, 72, 80.1, 90.1, 90.2, 91.1, 202, 19, 52/536, 537, 545
See application file for complete search history.

(56) References Cited

U.S. PATENT DOCUMENTS

| | | | | |
|---|---|---|---|---|
| 3,521,414 A | | 7/1970 | Malissa | |
| 3,791,088 A | | 2/1974 | Sandow et al. | |
| 3,828,494 A | | 8/1974 | Uhrhane et al. | |
| 3,967,423 A | | 7/1976 | Hammond | |
| 4,117,638 A | * | 10/1978 | Kidd et al. | 52/200 |
| 4,123,883 A | * | 11/1978 | Barber et al. | 52/200 |
| 4,155,206 A | | 5/1979 | Player | |
| 4,296,581 A | | 10/1981 | Heckelsberg | |
| 4,470,230 A | | 9/1984 | Weisner | |
| 4,520,604 A | | 6/1985 | Halsey et al. | |
| 4,543,753 A | * | 10/1985 | Sonneborn et al. | 52/15 |
| 4,559,753 A | | 12/1985 | Brueske | |
| 4,621,466 A | | 11/1986 | Sonneborn et al. | |

(Continued)

FOREIGN PATENT DOCUMENTS

| | | |
|---|---|---|
| GB | 981948 | 2/1965 |
| JP | 2000336859 | 5/2000 |

(Continued)

OTHER PUBLICATIONS

Cross-section and pictorial views of SSR-TUF-LITE daylighting panels, 1 sheet.

(Continued)

*Primary Examiner* — Andrew Triggs
(74) *Attorney, Agent, or Firm* — Thomas D. Wilhelm; Wilhelm Law, S.C.

(57) ABSTRACT

This invention provides support structures on roofs. Such support structure can be used to support a roof load, or a closure structure which closes an aperture in the roof, thus to provide access to the interior of a building through an aperture in the roof. The support structure can support a skylight to provide natural day-lighting, or a smoke vent, or a variety of other loads optionally relating to matter or energy communication between the inside and outside of the building. The support structure includes rails adapted to be supported by adjacent rib elevations on opposite sides of a flat of a roof panel, elevated above the water line of the panel flat. Where the support structure surrounds an aperture, a diverter seals a cut away portion of the rib structure and diverts water through the rib structure and laterally away from the rail and closure structure.

33 Claims, 18 Drawing Sheets

U.S. PATENT DOCUMENTS

| | | | | |
|---|---|---|---|---|
| 4,649,680 | A | 3/1987 | Weisner et al. | |
| 4,703,596 | A | 11/1987 | Sandow | |
| 4,730,426 | A | 3/1988 | Weisner et al. | |
| 4,776,141 | A | 10/1988 | Powell | |
| 4,825,608 | A | 5/1989 | Makin | |
| 4,848,051 | A | 7/1989 | Weisner et al. | |
| 4,860,511 | A | 8/1989 | Weisner et al. | |
| 4,986,039 | A | 1/1991 | Weisner | |
| 5,027,576 | A | 7/1991 | Gustavsson | |
| 5,323,576 | A | 6/1994 | Gumpert et al. | |
| 5,511,354 | A | 4/1996 | Eidson | |
| 5,522,189 | A * | 6/1996 | Mortensen et al. | 52/200 |
| 5,561,953 | A | 10/1996 | Rotter | |
| 5,896,711 | A | 4/1999 | McClure | |
| 6,079,167 | A | 6/2000 | Voegele, Jr. | |
| 6,151,838 | A | 11/2000 | Husein | |
| 6,640,508 | B2 | 11/2003 | Lindgren et al. | |
| 6,966,157 | B1 | 11/2005 | Sandow | |
| 7,043,882 | B2 | 5/2006 | Gumpert et al. | |
| 7,296,388 | B2 | 11/2007 | Valentz et al. | |
| 7,308,777 | B2 * | 12/2007 | Sandow | 52/200 |
| 7,395,636 | B2 | 7/2008 | Blomberg | |
| 7,712,279 | B2 | 5/2010 | McClure | |
| 7,721,493 | B2 | 5/2010 | Skov et al. | |
| 7,736,014 | B2 | 6/2010 | Blomberg | |
| 2004/0049996 | A1 | 3/2004 | Blomberg | |
| 2005/0204674 | A1 * | 9/2005 | Marshall | 52/544 |
| 2006/0191230 | A1 | 8/2006 | Gumpert | |
| 2007/0094984 | A1 | 5/2007 | McClure | |
| 2007/0101665 | A1 | 5/2007 | Sandow | |
| 2008/0040993 | A1 | 2/2008 | Valentz et al. | |
| 2008/0190050 | A1 | 8/2008 | McClure | |
| 2010/0162643 | A1 | 7/2010 | Blomberg et al. | |
| 2011/0252726 | A1 | 10/2011 | McLain et al. | |
| 2011/0252727 | A1 | 10/2011 | McLain et al. | |

FOREIGN PATENT DOCUMENTS

| | | |
|---|---|---|
| JP | 2001214577 | 8/2001 |
| JP | 2008202372 | 9/2008 |
| WO | 2010040006 | 4/2010 |

OTHER PUBLICATIONS

Cross-section of VP TUF-LITE Panel—attached to the side of SSR rib, 1 sheet.

Cross-section of Butler Lite Panel—attached to the side of MR24 rib, 1 sheet.

FAA Facility, photos of skylight installation, 3 pages, Sacramento, CA, Sale made prior to 2007.

Siemens Building, photos of skylight installation, 6 pages, Sale made prior to 2007.

R & S Manufacturing and Sales Company, Inc., Standing Seam 24 Light, Quick Installation Instructions, Under/Over Seam Clip, 12 pages, Newbury Park, CA, date unknown.

R & S Manufacturing and Sales Company, Inc., SS 24 Light, The First Truely Thermally Broken Metal Building Skylight, informational sheet, 1 page, Newbury Park, CA, date unknown.

R & S Manufacturing and Sales Company, Inc., Enlarged photo of metal roof showing the down slope, 1 page, Newbury Park, CA, date unknown.

* cited by examiner

SUPPORT STRUCTURES ON ROOFS

BACKGROUND OF THE INVENTION

Various systems are known for supporting loads on roofs, and for installing skylights and/or smoke vents into roofs.

The most commonly used skylighting systems are those which incorporate translucent or transparent closure members, also referred to herein as lenses, into a framework which penetrates the roof support structure and may be supported from within the building, with the result that the skylight closure member transmits ambient daylight into the building.

In the past, roof penetrating installations have required a complex structure beneath the exterior roofing panels and inside the building enclosure in order to support a roof curb to which the skylight lens was attached. Conventional skylight curbs are generally in the form of a preassembled box structure, which is mounted within a roof aperture. The retrofitting of such curb systems into an existing roof structure is problematic in that all known conventional structures have a tendency to leak water when subjected to rain due to installation details and complexities which are affected by installation techniques or workmanship.

U.S. Pat. No. 4,296,581, Heckelsberg, issued Oct. 27, 1981, teaches a roof structure having a series of metal panels having flanges that interlock when the panels are laid side by side and which are subsequently tightly seamed together to convert the individual panels into an integrated roof forming membrane. This roofing structure is mounted to the building purlins with clips and permits the panels to expand or contract in response to temperature and pressure changes.

U.S. Pat. No. 4,703,596, to Sandow, issued Nov. 3, 1987, and titled "Grid Skylight System", teaches a grid skylight support apparatus that includes prefabricated grid row frames, each formed of connected beam supports which define a number of bays. Each bay has a skylight curb formed by upper flanges of the beam supports to receive a preassembled skylight unit. The sides of each grid row frame provide mating edges that can register with the mating edges of adjacent other grid row frames during assembly. The skylights have peripheral support skirts that register upon each bay and a light-transmitting skylight panel to cover the peripheral support. Cross gutters on each grid row frame, which are positioned between adjacent skylights, extend at angles toward the respective mating edges of the grid row frame for carrying rainwater to a main gutter channel formed by field-assembly of the mating edges of two adjacent grid row frames. The main gutter channel includes a pair of longitudinally extending gutter sections, each having a main gutter channel surface with a lower elevation than the elevation of the cross flow channel. Fasteners assemble the grid row frame mating edges together and a continuous seal is provided to prevent rainwater leakage at the mating edges of adjacent grid row frames.

U.S. Pat. No. 4,520,604, to Halsey et al., issued Jun. 4, 1985, entitled "Skylight Structure", teaches a curb structure dimensioned to be passed through an opening in a roof and then attached in asserted moisture impervious relation to the roof from within a building interior. A skylight assembly including a frame, and light transmitting member secured to the frame is dimensioned to be passed through the opening and attached in a sealing engagement to the curb structure from within the building interior for covering the opening. The skylight assembly is then secured to the rafters and headers at an interior location. The frame includes upper and lower clamping jaws and spaced fulcrum links attached to the jaws for clamping the light transmitting member thereto. The lower clamping jaws include a channel which engages and is interlocked with the curb structure.

Other skylight systems, as contemplated in U.S. Pat. No. 4,470,230, by Weisner, provide a prefabricated skylight support curb that is formed to be a protective packaging for the skylight during shipment and then used as a curb for mounting the skylight on a roof. A prefabricated skylight support curb for supporting a skylight thereover has a bottom flange angled, upright sides, and a top lip round the top of the sides forming an opening through the curb. A skylight is adapted to cover the opening through the skylight support curb, and has a domed portion and a drip edge on the curb portion. The skylight curb portion is shaped to fit over a portion of the prefabricated skylight support curb angled upright portion and top lip. The skylight support curb is shaped to nest an accompanying skylight therein having the skylight curb portion adjacent to the interior of the skylight support curb angled upright walls to protect the skylight during shipping and storing.

Another skylight system, U.S. Pat. No. 3,791,088, Sandow, et al., teaches prefabricated multiple dome unit or skylights and composite provided, where each multiple dome unit has several domes of transparent or translucent material mounted together on a common frame, and means are provided for assembling a plurality of such dome units into a composite thereof on a building, with the units lapped and interfitted so as to provide a continuous drainage system discharging to the exterior of the units in the composite assembly.

U.S. Pat. No. 4,621,466, by Sonneborn et al., teaches a flashing frame described for roof windows to be installed adjacent to each other with edges facing each other. Connecting flanges of the upper flashing members extend beneath the roofing and, if need be, lower flashing members and intermediary flashing members extend obliquely outwardly.

In today's world of mandated energy efficiency in all types of buildings, the metal building industry needs a more effective way to support skylights and smoke vents, thus to bring daylight into buildings, as well as a more effective way to support a variety of other loads on roofs which have ribs extending the lengths of the metal panels which serve as the outer surfaces of such roofs.

To ensure adequate daylighting, conventional skylight and smoke vent installations require multiple roof apertures which extend cut through and remove plural major elevations, also referred to herein as ribs, in standing seam and other roof panel profiles to make room for a corresponding multiple curbs which are conventionally used to support such skylight or smoke vent installations. These multiple curbs, each around a separate roof aperture, create multiple opportunities for water to enter the interior of the building, due to multiple apertures and the widths of the curbs, thus the cuts through the multiple ribs, as well as presenting the challenge to effectively seal the roof at the high ends of such curbs.

The traditional curb constructions and methods of attachment in most cases thus require that a complicated support structure be installed below the roof panel and inside the building enclosure, which can restrict the relative movement of the roof panels and the curb, as associated with thermal expansion and contraction of the overlying metal roof due to temperature changes and the like.

None of the prior approaches have been able to provide an installation system for multiple skylights which accomplishes the goals of economy and simplicity of installation and which works equally well for new buildings and as retrofits in existing buildings.

SUMMARY OF THE INVENTION

The invention provides a curbless construction system for installing roof load supports such as roof closure structures, optionally skylights and/or smoke vents, optionally including two or more adjacent roof closure structures, end-to-end, onto the major rib elevations of a building's metal roof panel system, thus utilizing the beam strength of the rib elevations in supporting such loads. Numerous roof structures include such rib elevations, sometimes deemed "ribs" or "corrugations", including the standing seam, snap seam and "R" panel roof types. The roof support and/or closure structures of the invention are fastened to the rib structures of the metal roof panels above the water line. By mounting the loads above the water line, the number of incidents of water leaks is greatly reduced. By mounting the loads on the roof panels, themselves, the supported loads, such as skylights or vents, can move with the respective roof panels as the roof panels expand and contract.

The invention utilizes the beam strength of the rib elements of the roof panels as an integral part of the closure support structure.

In a first family of embodiments, the invention comprehends a roof adaptive system configured to be installed as a roof-penetrating, environment-accessing structure on a metal roof, such metal roof comprising a metal roof profile defined by a plurality of roof panels having lengths, and arranged side by side, edges of adjacent such roof panels meeting at elevated rib structure portions thereof. The roof adaptive system comprises a rail and closure structure configured to be supported by adjacent ones of the elevated rib structures of the respective roof panels; a closure member configured to be supported on said rail and closure structure; and a diverter member configured to seal a cut away portion of such rib structure, thus to divert water away from the rail and closure structure.

In some embodiments, the rail and closure structure comprises an elongate rail configured to conform to at least a portion of a cross-section of such rib structure, along the length of such elevated rib structure.

In some embodiments, the rail and closure structure comprises first and second elongate rails configured to conform to respective first and second rib structure on respective adjacent roof panels.

In some embodiments, the roof adaptive system further comprises an upper end diverter configured to conform to an upper surface profile of such roof panel as is to be spanned by the rail and closure structure, and to close off the rail and closure system at the upper end thereof from intrusion of water.

In some embodiments, the roof adaptive system further comprises a lower end roof panel profile closure configuration to close off the lower end of the rail and closure structure from intrusion of water.

In some embodiments, the lower end roof panel profile closure conforms to the elevated rib structure of a known such roof panel.

In some embodiments, the lens comprises a skylight lens mounted to a skylight frame which extends about a perimeter of the lens, the skylight frame being fastened to the rail structure at spaced locations along the length of the rail structure.

In some embodiments, the aperture closure comprises an operable vent which can be alternatively closed, and opened to the outside environment.

In a second family of embodiments, the invention comprehends a building, comprising a building structural support system; and a roof supported by the structural support system. The roof comprises a plurality of elongate roof panels arranged in side-by-side relationship, the roof panels having first lengths, defining opposing first and second ends thereof, and opposing first and second sides of the roof panels, the sides of the roof panels comprising elongate elevated rib structure, the elevated rib structure on a first such roof panel being joined with the elevated rib structure on adjacent roof panels to form first and second elevated ribs at such joinder, the roof panels further comprising panel flat portions between the elevated ribs, an aperture in the roof, the aperture being confined within the width of a single such roof panel, and a roof-penetrating, environment-accessing structure. The environment accessing structure comprises a rail and closure structure having a second length defining third and fourth ends thereof, and a second width, corresponding directionally to the first lengths and the first widths of the roof panels, first and second elongate rails extend along the length of the rail and closure structure, the first and second rails being attached to the elevated ribs at spaced locations along the lengths of the ribs and the rails, the rail and closure structure spanning the width of a single roof panel plus optionally a rib portion of an adjacent roof panel. A diversion slot has a width corresponding in direction to the length direction of the respective panels. The diversion slot extends across an elevated rib at, and extends away from the upper end of the rail and closure structure, and at an elevation corresponding with an elevation of the respective said panel flat. At least one closure panel is secured to, and supported by, the rails, and a diverter is disposed in the diversion slot, extending the width of the diversion slot and extending across the respective rib, thereby to divert water laterally away from the end of the environment-accessing structure and onto the adjacent roof panel.

In some embodiments, the elongate rails have cross-section profiles which parallel cross-section profiles of the respective elevated ribs such that the rails are in substantial face-to-face contact with the respective ribs along the lengths of the ribs and the rails.

In some embodiments, the environment-accessing structure comprises at least first and second environment-accessing structures in side-by-side relationship to each other and overlying a single aperture.

In some embodiments, the rail and closure structure is secured to and moves with elevated ribs.

In some embodiments, the first and second rails conform to profiles of the first and second ribs along the lengths of the respective roof panels.

In some embodiments, the rails are configured to conform to surfaces of respective ribs, whereby the environment-accessing structure moves with expansion and contraction of the respective ribs.

In some embodiments, the roof comprises a sloped roof, and comprising an upper end diverter configured to conform to a top surface profile of the respective roof panel overlain by the environment-accessing structure at an upper end of the environment-accessing structure, and closing off the rail and closure structure at such upper end thereof from intrusion of water into the roof aperture.

In some embodiments, the environment-accessing structure further comprises a lower end roof panel profile closure, closing off the lower end of the rail and closure structure from intrusion of water.

In some embodiments, the lower end closure conforms to the outer surfaces of the respective elevated ribs.

In some embodiments, the aperture closure comprises a skylight lens mounted to a skylight frame, the skylight frame extending about a perimeter of the lens, the skylight frame being mounted to the rail structure, at spaced locations along the length of the rail structure.

In some embodiments, the aperture closure panel comprises a skylight lens.

In some embodiments, the aperture closure comprises a smoke vent lens.

These and other features and advantages of this invention are described in, or are apparent from, the following detailed description of various exemplary illustrated embodiments of apparatus and methods according to this invention.

BRIEF DESCRIPTION OF THE DRAWINGS

A more complete understanding of the present invention and the attendant features and advantages thereof may be had by reference to the following detailed description when considered in conjunction with the accompanying drawings wherein various figures depict the components and composition of the multiple skylight system.

Figure 1:
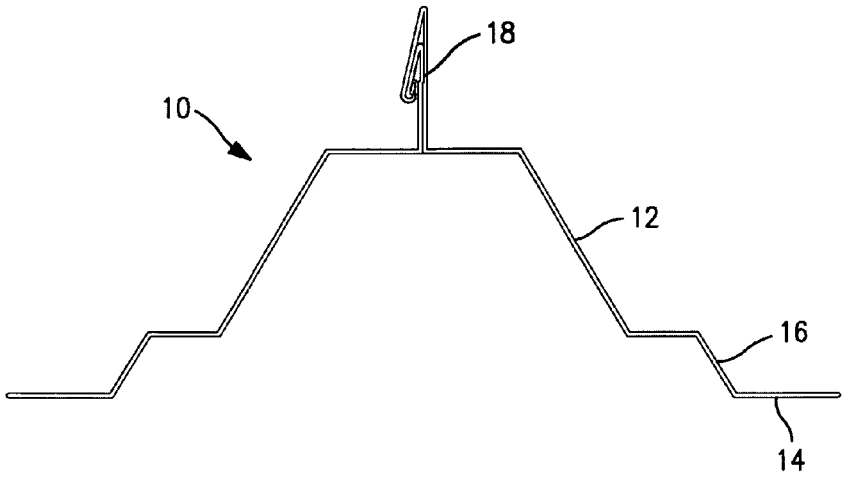
FIG. 1 is a view showing the roof profile of a metal roof of the type known as the standing seam roof panel.

The invention is not limited in its application to the details of construction, or to the arrangement of the components set forth in the following description or illustrated in the drawings. The invention is capable of other embodiments or of being practiced or carried out in various other ways. Also, it is to be understood that the terminology and phraseology employed herein is for purpose of description and illustration and should not be regarded as limiting. Like reference numerals are used to indicate like components.

DETAILED DESCRIPTION OF THE ILLUSTRATED EMBODIMENTS

The products and methods of the present invention provide a load support structure, optionally a rail and closure structure for use in installing various exterior roof loads, as well as structures which close off apertures in metal roofs. For purposes of simplicity, "roof penetrating structures" and "skylights" will be used interchangeably to mean various forms of roof structures installed on the upper surface of the roof which collectively define an upstanding enclosing wall which defines a surrounded space about an aperture in a roof, and which closes off the roof aperture while providing for passage of light and/or ventilation, air handling, vents, air intake, air or other gaseous exchange to and/or from the interior of the building. In the case of roof ventilation, examples include simple ventilation openings, such as for roof fans, and smoke vents, which are used to allow the escape of smoke through the roof during fires. In the case of exterior loads on the roof, there can be mentioned, without limitation, such loads as air conditioners, air handlers, solar panels and other equipment related building utilities, and/or to controlling water or air temperatures inside the building. The only limitation regarding the loads to be supported is that the magnitude of a load must be within the load-bearing capacity of the roof panel or panels to which the load is mounted.

The number of skylights or other roof loads can vary from one structure, to as many structures as the building roof structure can support, limited only by the amount of support provided by the surrounding roof surface structure, and with the support capabilities, e.g. at the ribs, being left largely intact during the installation process.

The closure system of the invention utilizes the beam strength of the major rib structure in the roof panels as the primary support structure for mounting and fastening the e.g. skylight assembly to the roof. Typical conventional skylight installations do not allow for skylights to be mounted to each other, end to end, in continuous runs without intervening roof structure along the lengths of such runs. Rather, typical conventional skylight installations use a curb construction surrounding and supporting each skylight lens, the curb structure being typically 2-4 times wider than skylight support structure used in the present invention and 2-4 times wider than the roof panels on the roof.

The skylight system of the invention does not require any structure underneath the roofing panels inside the building enclosure. Neither does the skylight system of the invention require a separate curb construction to support or mount or attach each skylight to the roof. Rather, the load support system of the invention is overlaid onto, and mounted to, the roof panels at the standing ribs, and allows for thermal expansion and contraction of the load support system along with thermal expansion and contraction of the respective roof panel or panels by utilizing major profiles of the e.g. conventional metal roof panels for support. This is accomplished through direct attachment of the load support system of a skylight of the invention to the underlying ribs.

In reference now to the figures, the system allows the installation of two or more adjacent skylights in an end to end relationship along the major rib structure of a metal roof panel on the building.

The skylight systems of the invention can be applied to various types of ribbed roof profiles. FIG. 1 is an end view showing the roof profile of a metal roof of the type known as a standing seam roof. These include the "standing seam" roof, which has trapezoidal major ribs 12 typically 24" to 30" on center. Each roof panel 10 also includes a panel flat 14, and a shoulder 16 between the elevated ribs on the respective elongate sides of the panel, and the elevated ribs cooperate with corresponding elevated ribs on next-adjacent panels, thus forming standing seams 18. The rib elevations on respective adjacent panels are folded over to collectively create the standing seams, thus to prevent water from penetrating the roof at the standing seams.

Figure 2:
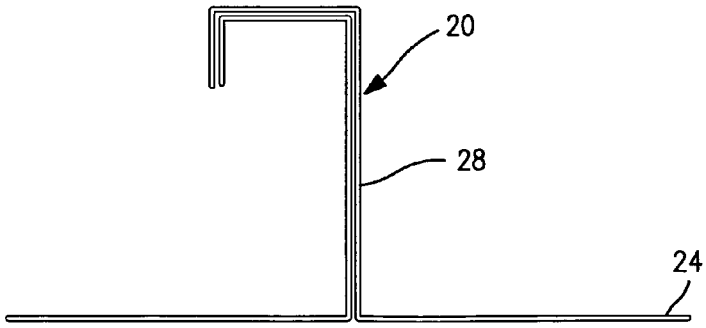
FIG. 2 is a view showing the roof profile of a metal roof of the type known as an architectural standing seam roof.

FIG. 2 is an end view showing the roof profile of a metal roof of the type known as an architectural standing seam roof, which uses a series of overlapping architectural standing seam panels 20. Each panel 20 comprises a panel flat 24, with an architectural standing seam 28 formed at the panel interconnections.

Figure 3:
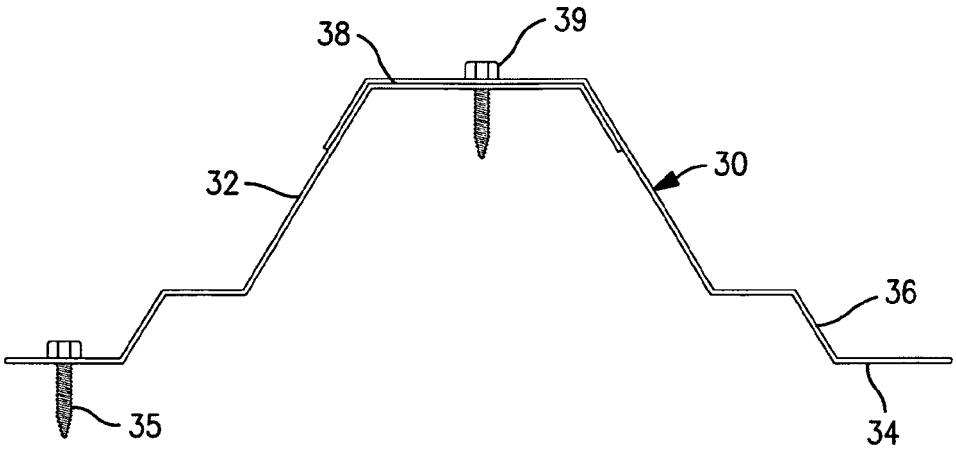
FIG. 3 is a view showing the roof profile of a metal roof of the type commonly referred to as a snap seam roof.

FIG. 3 is a view showing the roof profile of a metal roof of the type commonly referred to as an R panel or exposed fastener panel 30. Each panel has a rib 32, and a panel flat 34. Adjacent R panels are secured to the roof through structural fasteners 35. At shoulder 36, which is formed from overlapping regions, or at side lap 38, the adjacent panels are secured through stitch fasteners 39. Trapezoidal major ribs of the R panel roof are most typically formed at 8 inches to 12 inches on center.

Figure 4:
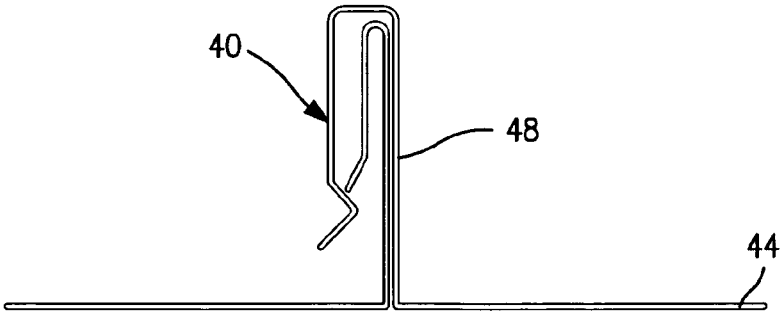
FIG. 4 is a view showing the roof profile of a metal roof of the type commonly referred to as an exposed fastener roof panel.

FIG. 4 is a view showing the roof profile of a metal roof of the type commonly referred to as a snap rib seam panel 40. Snap seam panels 40 have a panel flat 44 and a standing seam or snap seam 48 where the adjacent panels meet.

Figure 5:
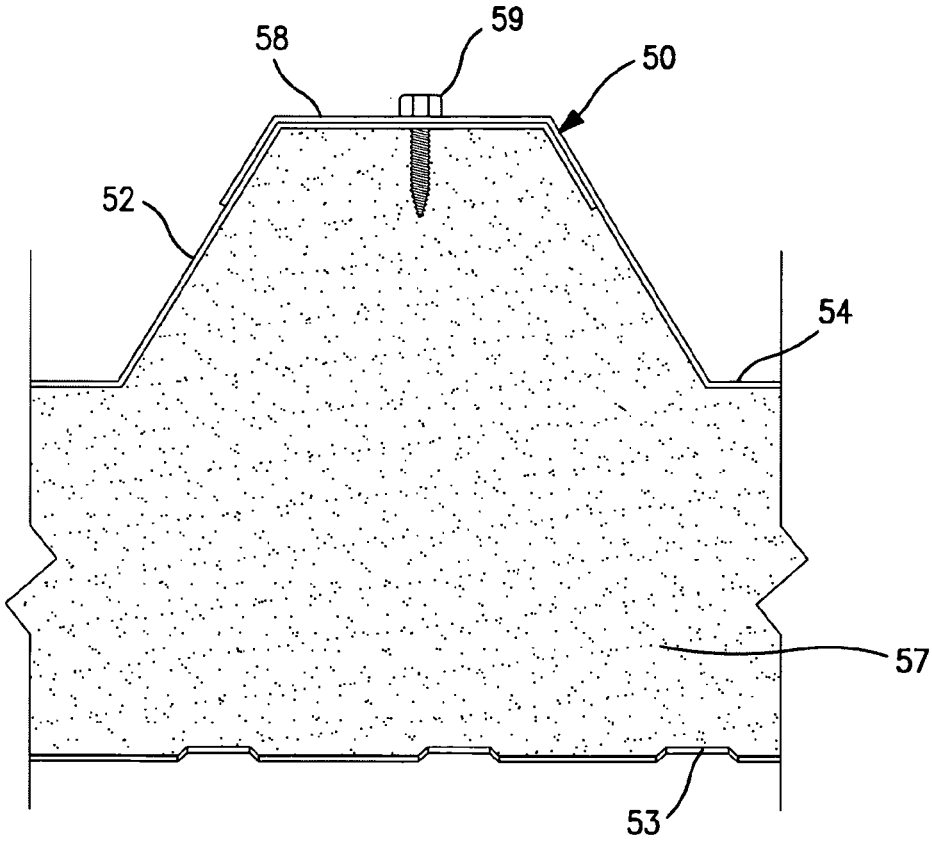
FIG. 5 is a view showing the roof profile of a metal roof of the type commonly known as foam core panel.

FIG. 5 is a view showing a roof profile of a metal roof of the type commonly referred to as using a foam core panel 50. Such roof has a rib 52, a liner panel 53, a panel flat 54 and a foam core 57. Side laps 58 are secured by stitch fasteners 59. Such roof panels are typically installed from the interior of the building.

A skylight/ventilation support structure is illustrative of roof-penetration closure structures of the invention, and includes a rail and closure structure adapted to be supported by the prominent elevations, seams, rib structures, or other structural elements of conventional such roof profiles, where the standing structure of the roof system, namely structure which extends above the panel flat, e.g. at seams which mount adjoining exterior roof panels to each other, provides the support for the load support structures, and the roof-penetration closure structures, e.g. skylight/ventilation assemblies, are secured to the conventionally-existing elements of the roof structure, namely to the conventional metal roofing panels, and overlie an opening formed largely in the intervening, non-structural roof flat region and without removing significant portions of the rib/seam/elevation structures.

Figure 6:
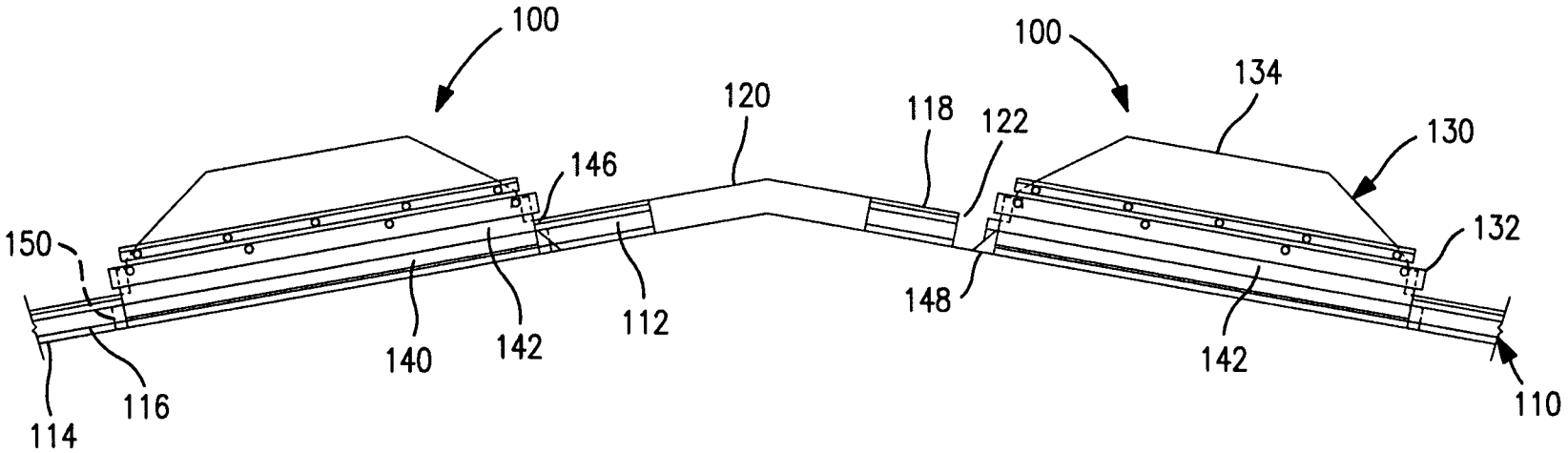
FIG. 6 is a side view showing major components of the system as installed in a metal roof.

Turing now to FIG. 6, there is shown two exemplified load support structures 100, overlain by skylight lens subassemblies, and attached to a standing seam panel roof 110. While FIG. 6 depicts such assembly, the components of the load support structures can be adapted, by shaping of the elements, for attachment to any roof system which has a profile which includes elevations, above the panel flat, which provide places for structural support of the respective skylight or other roof-mounted assemblies or other roof-mounted loads.

Figure 7:
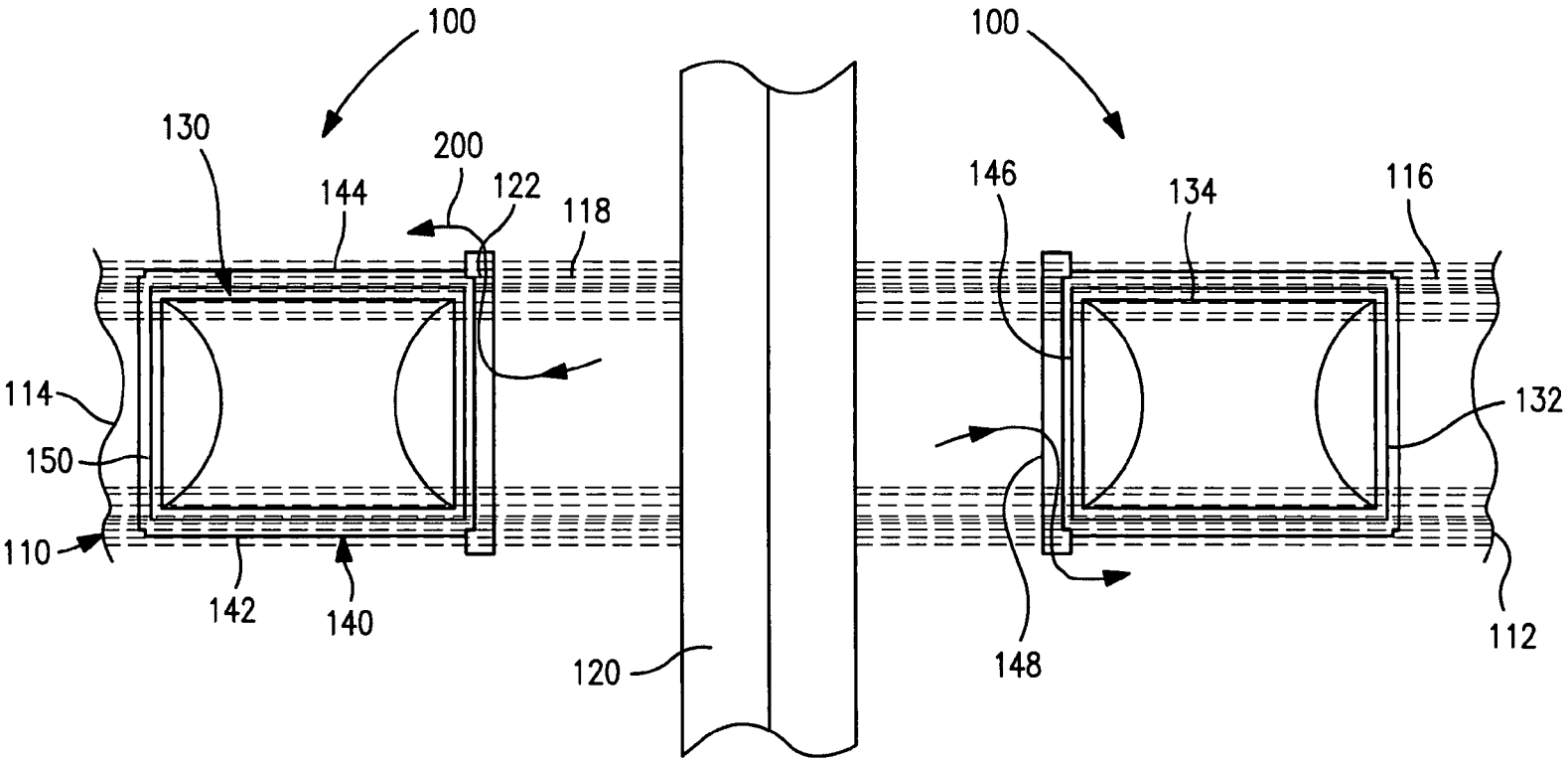
FIG. 7 is a top plan view of the installed system, showing the placement of skylights and the direction of water flow over the roof.

Looking again to the figures, particularly FIGS. 6 and 7, there is shown a portion of such a standing seam panel roof 110, in dashed outline, having structural and other elements including a raised rib 112, a panel flat 114, shoulder 116 and standing seam 118. Given that water generally seeks the lowest level available, rib 112, shoulder 116, and standing seam 118 are all generally above the water line. Also depicted in FIGS. 6 and 7 are ridge cap 120 of the roof structure, and cutaway regions, or gaps 122 in the raised ribs 112, the gaps being formed to accommodate the closure structure, as described more fully following.

Shown as part of the system, and exemplified in this case, is a skylight lens subassembly 130, generally comprising a skylight lens frame 132 extending about the perimeter of an aperture in the roof, and a skylight lens 134. An exemplary such skylight lens is that taught in U.S. Pat. No. 7,395,636 Blomberg and available from Sunoptics Prismatic Skylights, Sacramento, Calif.

While the figures depict a skylight, the rail structure, with or without end closures, can be used to mount a wide variety of loads on such roof, including various types of skylights, smoke vents, air conditioning, other vents, air intakes, air and other gaseous exhausts, electrical panels or switching gear, and/or other roof loads, including roof-penetrating structures, all of which can be supported on rail structures of the invention.

Again referring to FIGS. 6 and 7, the load support structure of the invention, as applied to a skylight installation, includes a rail and closure structure 140, generally comprised of side rails 142 and 144, and upper diverter 146 disposed adjacent the rib cutaway section, or gap 122 and a lower end closure. A sealing portion of the upper diverter may be located in gap 122, sealing the sides and bottom of the gap against water leakage into the building and carrying water laterally across the width of the respective rib, to the panel flat 114 of the adjacent roof panel, thus to transport the water away from the upper end of the skylight and to prevent the water from leaking through the roof opening.

FIG. 7 shows how gap 122 in roof rib 112 provides for water flow, as illustrated by arrow 200, causing the water to move laterally along the roof surface, over the sealing portion of the upper diverter, and down and away from the roof ridge cap 120 in panel flats 114 of roof panels which are adjacent the roof structures which support the respective e.g. skylights.

Lower end closure 150 closes off the roof aperture from the outside elements at the lower end of the e.g. skylight, thus to serve as a barrier to water leakage at the lower end of the roof opening.

Figure 8A:
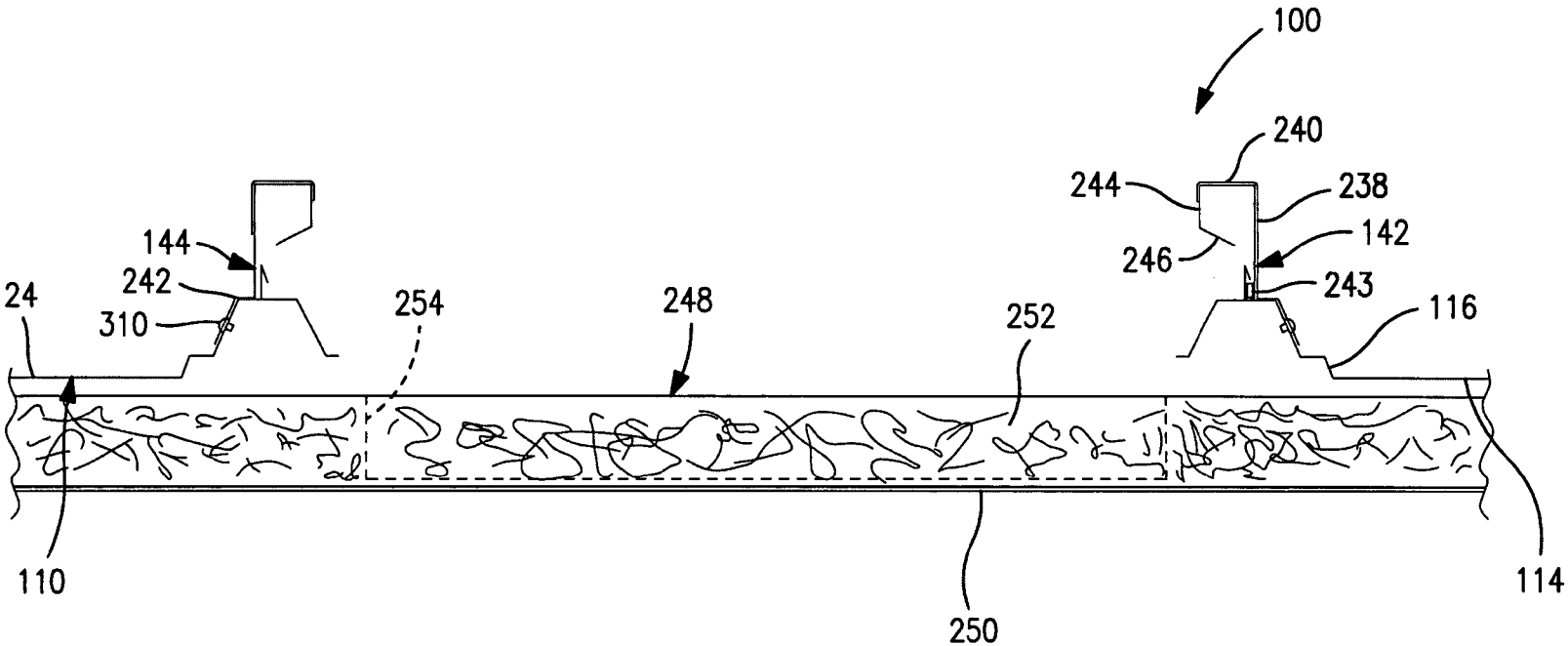
FIG. 8A is a cross sectional view showing the connections of the skylight frame to the rail and closure structure, over a metal panel roof where the flat has been removed; the rail and closure structure being affixed to the surface of adjacent rib elevations, wherein the portion of the underlying insulation which is to be removed is shown in dashed outline, and a gap plug has been installed between the standing seam and the rail on the right side of the drawing providing relatively solid mass in the gap between the folded-over standing seam and the side of the rail.

Referring now to FIG. 8A, a cross section through the load support structures 100 shows the securement of the structures 100 to standing rib portions of the standing seam panel roof 110. FIG. 8 depicts the use of ribs 112 to support the side rails 142 and 144 on opposing sides of the panel flat 114. Each rail 142 or 144 has an outer panel 238 a rail upper flange or bearing panel 240 and a rail shoulder 242. Skylight frame 132 is secured to rails 142, 144 by fasteners 300, only one of which is shown, spaced along the length of the rib.

A rail shoulder 242 is shaped to fit closely over the outside of the roof rib 112, and is secured to roof rib 112 by e.g. rivets 310, only one of which is shown, spaced along the length of the rib. A gap plug 243 is disposed in the standing seam gap between the turned-over edge of the standing seam and the rail on the right side of the drawing, both at the upper diverter and at the lower closure. The plug, made of a relatively solid, yet resilient, e.g. EPDM (ethylene propylene diamine monomer) rubber provides relatively solid mass in the standing seam gap between the folded-over standing seam and the side of the rail, and relatively softer tape mastic and tube caulk or the like are used to fill in the thus relatively smaller spaces which remain after the gap plug has been inserted in the respective standing seam gap. Rail bearing panel 240, at the top of the rail, is adapted to support skylight frame 132 seen in FIG. 8D. Inside panel 244 extends down from the inner edge of bearing panel 240. Capture panel 246 extends at an obtuse angle, illustrated at about 135 degrees, from the lower end of inside panel 244. Insulation 248 is shown below the aperture in the metal roof panel. Insulation 248 has a facing sheet 250 underlying a layer of e.g. fiberglass batt material 252. Dashed line 254 outlines the approximate portion of the insulation which is to be removed.

Rail and closure structure 140 is representative of load support structure 100 and can be produced to fit closely along the contour of roof 110, and can be so configured to have end portions that match the cross-panel contours of the respective ribs 112. The various mating surfaces of structure 140 and roof 110 can be sealed in various ways known to the roofing art, including caulking or tape mastic, and various rubber fittings or inserts such as gap plug 243 can be used to seal around the open area of the aperture in the roof.

Figure 8B:
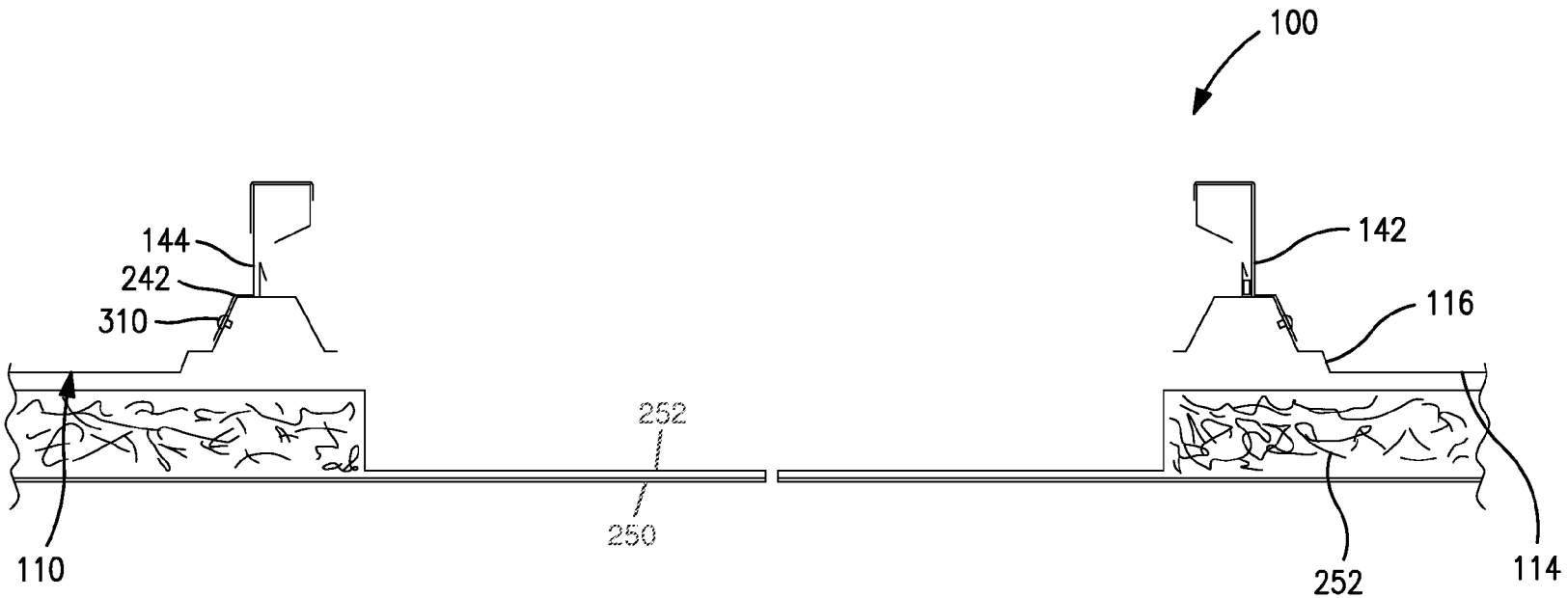
FIG. 8B shows a cross-section as in FIG. 8A, after removal of that portion of the insulation which was to be removed, and the facing sheet cut down the middle for the length of the skylight lens which is to be installed in the respective portion of the aperture in the metal roof.

FIG. 8B shows the insulation batt material, marked with a dashed outline in FIG. 8A, removed from under the central portion of the aperture in the metal roof panel, leaving a relatively thin layer of batt material still attached to the facing sheet. In addition, at the step shown in FIG. 8B, the facing sheet has been cut the full length of the skylight lens which is to be installed over the respective portion of the aperture in the roof panel.

Figure 8C:
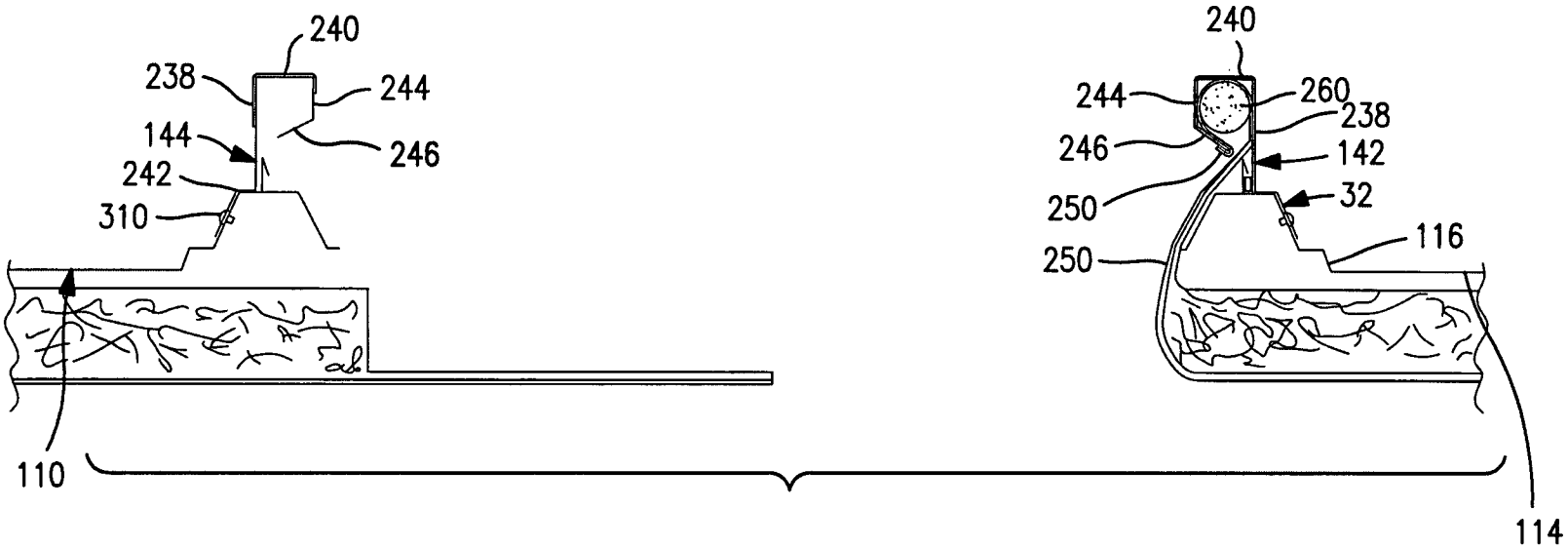
FIG. 8C shows a cross-section as in FIGS. 8A and 8B wherein the facing sheet on one side of the opening has been raised and tucked into the cavity in the rail, and is being held in the cavity by a foam retainer rod.

FIG. 8C shows the facing sheet and the thin layer of batt material lifted out of the aperture. The facing sheet has been raised, and drawn snug against the side of rib 32 and rail 142, and a resilient foam retaining rod 260 has been forced into cavity 264 in the rail, with the facing sheet captured between the retaining rod and the rail surfaces which define cavity 264. Facing sheet 250 enters cavity 264 against outer panel 238 of the rail, extends up and over/about rod 260 in the cavity, and thence extends back out of cavity 264 to a terminal end of the facing sheet outside cavity 264. Thus, rod 260 holds the insulation adjacent the roof aperture while closing off the space above the insulation from the roof aperture.

The cross-section of rod 260 in cavity 264 is substantially greater than the slot-shaped opening 268 between capture panel 246 and outer rail panel 238. Thus retainer rod necessarily is deformable at least to the extent of being forced through opening 268, and is resilient to return to a shape which so fills cavity 264 that facing sheet 250 is retained in cavity 264 over the entire length of the rail. A highly resilient, yet firm, polypropylene or ethylene propylene copolymer foam is suitable for rod 260. A suitable such rod, known as a "backer rod" is available from Bay Industries, Green Bay, Wis.

Figure 8D:
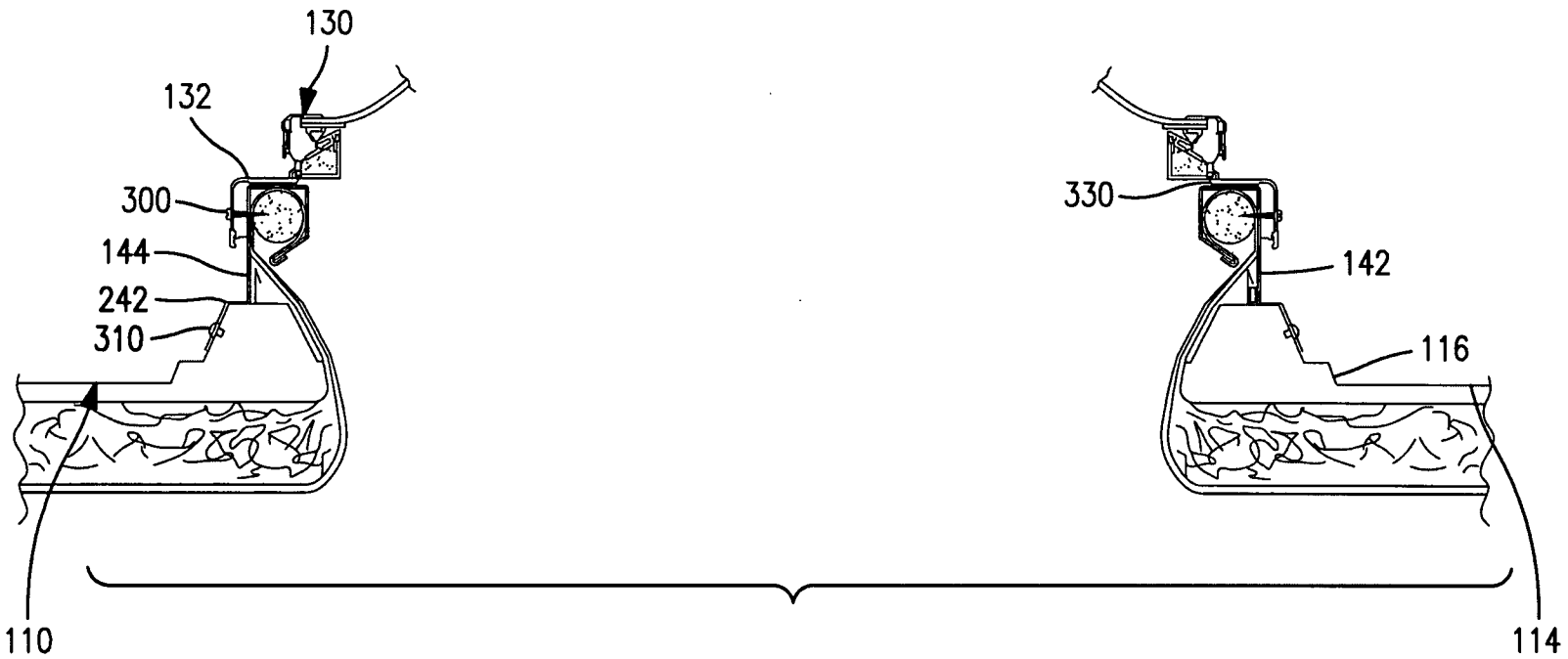
FIG. 8D shows a cross-section as in FIGS. 8A-8C wherein the facing sheet on both sides of the opening has been tucked into the rail cavity and is being held in the cavity by a thermally insulating foam retainer rod; and the skylight lens subassembly has been mounted to the rails, thus closing the aperture in the metal roof panel.

FIG. 8D shows the insulation facing sheet trapped in the rail cavities on both sides of the roof aperture. Upper and lower closures, discussed in more detail hereinafter, extend across, the flat of the metal roof panel at the upper and lower ends of rails 142, 144. The upper and lower closures have upper flanges having cross-sections corresponding to the cross-sections of rails 142, 144. Those upper flanges have corresponding flange cavities which are used to capture facing sheet 250 at the upper and lower closures. Thus, the facing sheet is trapped in a cavity at the upper reaches of the rail and closure structure about the entire perimeter of the rail and closure structure.

FIG. 8D further shows the skylight lens subassembly mounted to rails 142, 144. A sealant 330 is disposed between bearing panel 240 and skylight frame 132, to seal against the passage of water or air across the respective joint. A series of fasteners 300 extend through outer panel 238 of the rail and extend into resilient rod 260, whereby rod 260 insulates the inside of the of the roof aperture from the temperature differential, especially cold, transmitted by fasteners 300, thereby to avoid fasteners 300 being a source of condensation inside the space defined below the skylight lens.

Figure 9:
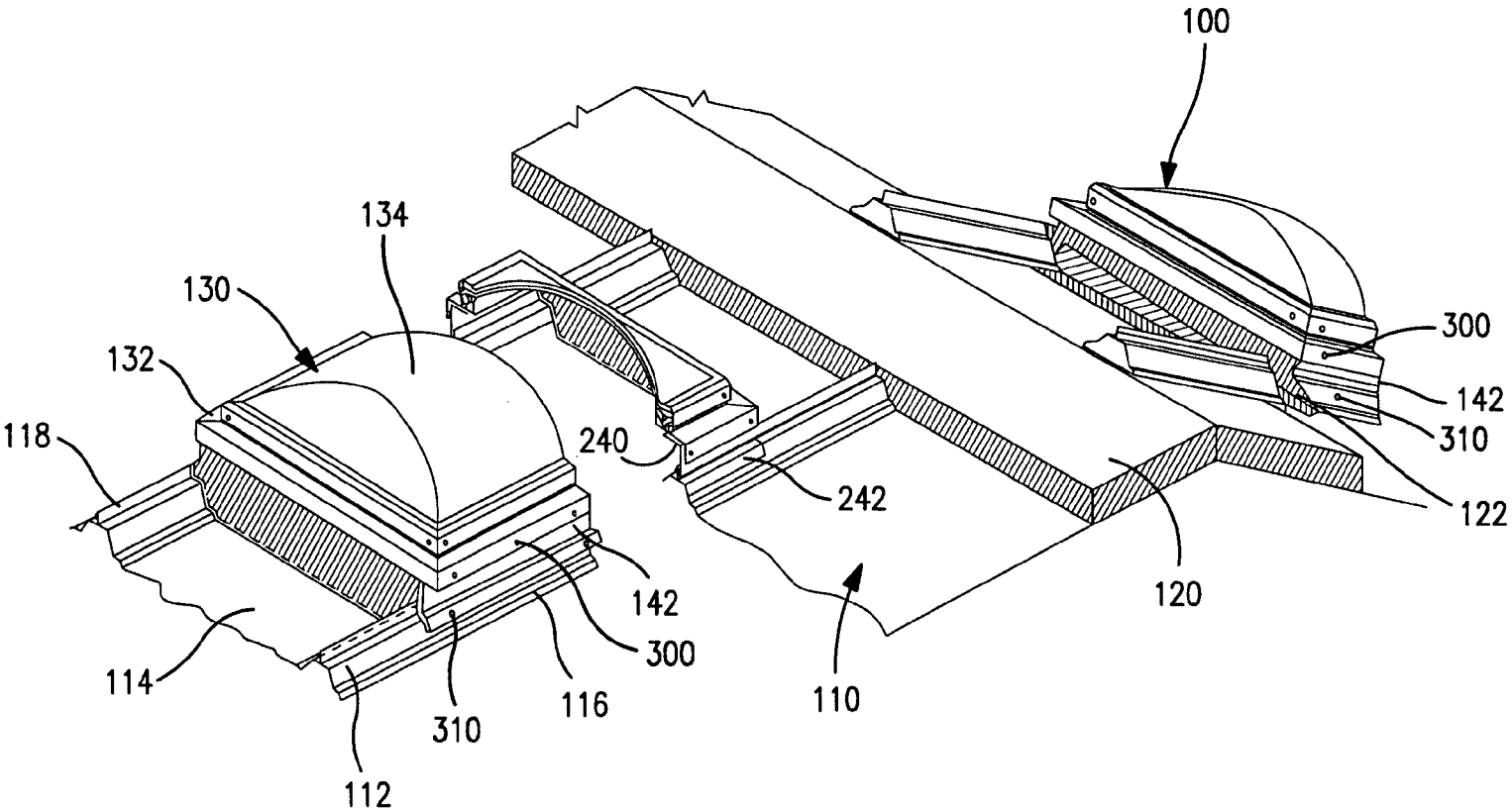
FIG. 9 is a perspective view partially cut away showing internal structure of the system as installed on the rib elevations of a metal roof.

In FIG. 9 a partially cut away perspective view of rail and closure structures 140 is used to show support of the rail and closure structure by standing seam panel roof 110, particularly the elevated rib 112 providing the structural support at the standing seams. FIG. 9 illustrates how the rail and closure structures incorporate the structural profiles of the roof panels of the metal roof structure above and below the skylights, and incorporate the elevations and ribs used in sealing adjacent ones of the panels, to provide the primary support, by the roof panels, for the loads imposed by the skylights. In this fashion, the load support structures of the invention adopt various ones of the advantages of a standing seam roof, including the beam strength features of the ribs at the standing seam, as well as the water barrier features of the standing seam.

Most standing seam roofs are seamed using various clip assemblies that allow the roof panels to float/move relative to each other, along the major elevations, namely along the joints between the respective roof panels, such joints being defined at, for example, elevated ribs 112, whereby each roof panel is free to expand and contract according to e.g. ambient temperature changes irrespective of any concurrent expansion or contraction of the next-adjacent roof panels. Typically, a roof panel is fixed at the eave and allowed to expand and contract relative to a ridge. In very wide roofs, the panels can be fixed at midspan, whereby the panels expand and contract relative to both the eave and ridge.

The design of the skylight system of the invention takes advantage of the floating features of contemporary roofing structures, such that when skylight assemblies of the invention are secured to respective rib elevations as illustrated in e.g. FIGS. 8 and 9, the skylight assemblies, themselves, are supported by the roof panels at ribs 112, and thus move with the expansion and contraction of the roof panels to which they are mounted.

FIG. 9 shows panel flat 114, rib 112, and shoulder 116, as well as standing seam 118. Ridge cap 120 is also shown, as well as the gap 122 in a rib 112.

Skylight subassembly 130 is supported by ribs 112, on rail and closure structure 140, as previously described.

Skylight frame 132 is secured by a series of fasteners 300 to rail and closure structure 140 at side rails 142 and 144 and rails 142 and 144 are secured to ribs 112 by a series of rivets 310.

In application, for each rail and closure structure 140, a short length of a single rib 112 is typically cut away, forming a gap 122 in the respective rib, to accommodate drainage at the high end of the rail and closure structure (toward ridge cap 120). Such gap is typically used with standing seam, architectural standing seam and snap seam roofs. Two ribs may be cut for roofs having an "R" panel profile.

The retained portions of rib 112, namely along the full length of the skylight as disposed along the length of the respective roof panel, provide beam-type structural support, supporting side rails 142 and 144 and maintaining the conventional watertight seal at the joints between roofing panels, along the length of the assembly. Internal portions of ribs 112 may be removed to allow additional light from skylight lens 130 to reach through the respective roof opening.

A bearing plate structure 148, illustrated in FIG. 7 and following the width dimension contour of the roof panel, is placed under the respective roof panel at or adjacent the upper end of the aperture in the roof. Fasteners are driven through a high end diverter, described further hereinafter, through the roof panel and into bearing plate structure 148, drawing the diverter, the roof panel, and the bearing plate structure close to each other and thus trapping the roof panel closely between the bearing plate and the diverter and closing off the interface between the panel and the diverter. Caulk or other sealant can be used to further reinforce the closure/sealing of that interface.

Bearing plate 148 can also be used to provide lateral support to link adjacent rib elevations 112 to each other, and is typically produced of steel or other material sufficient to provide a rigid substructure support to the skylight rail and closure structure at the high end of the rail and closure structure.

Rail and closure structure 140 is shaped in such a manner that the skylight subassembly can be easily fastened directly to the rails with rivets or other fasteners such as screws and the like as illustrated at 310 in FIG. 8. The rail and closure structure 140 may also be designed to accept a safety security guard before the skylight lens subassembly is installed.

Figure 10:
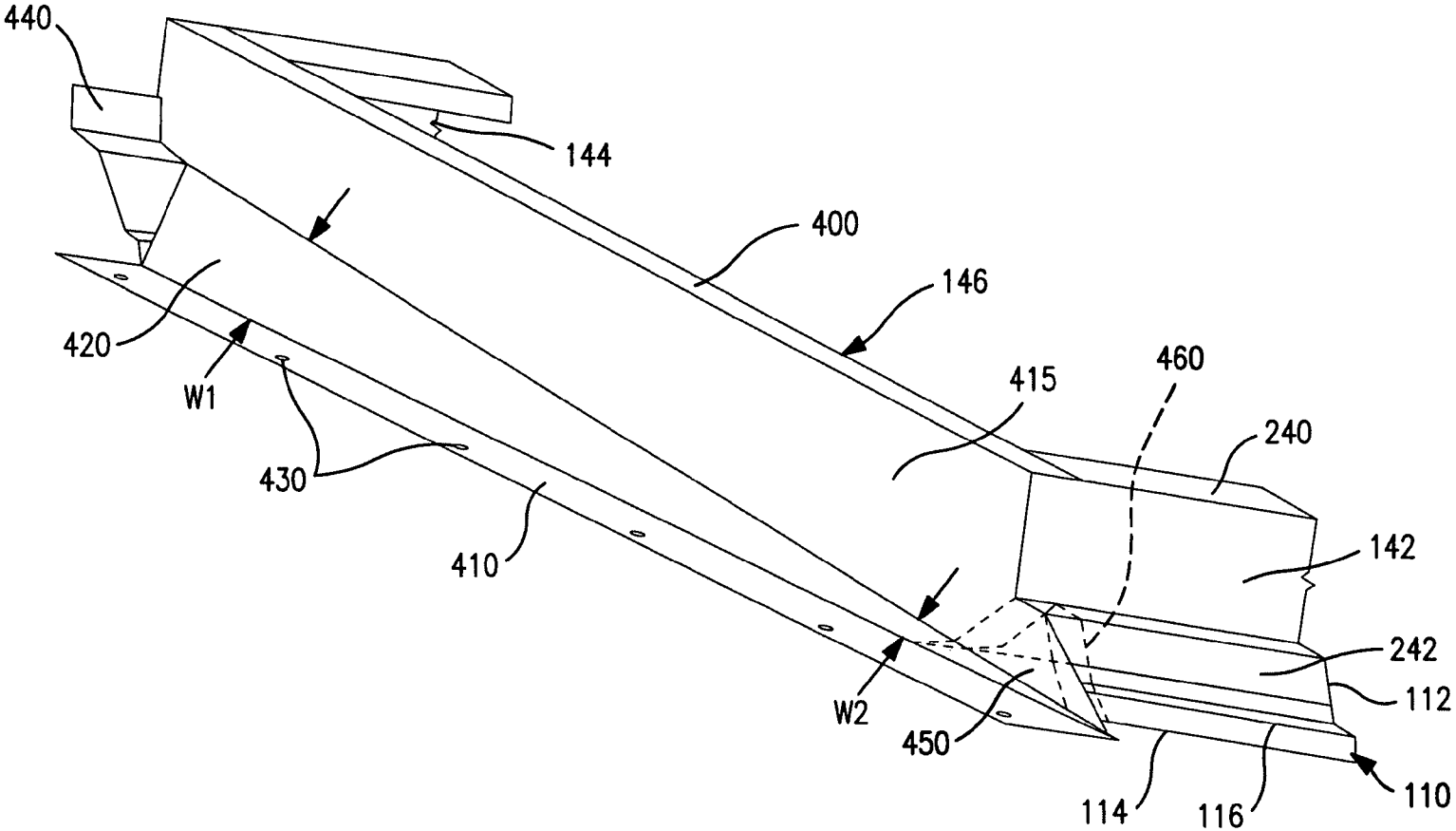
FIG. 10 is a perspective view of the upper diverter showing trailing closure flaps extending from the ends of the intermediate end panel, and closed over the upright sides of the respective side rails.
Figure 11:
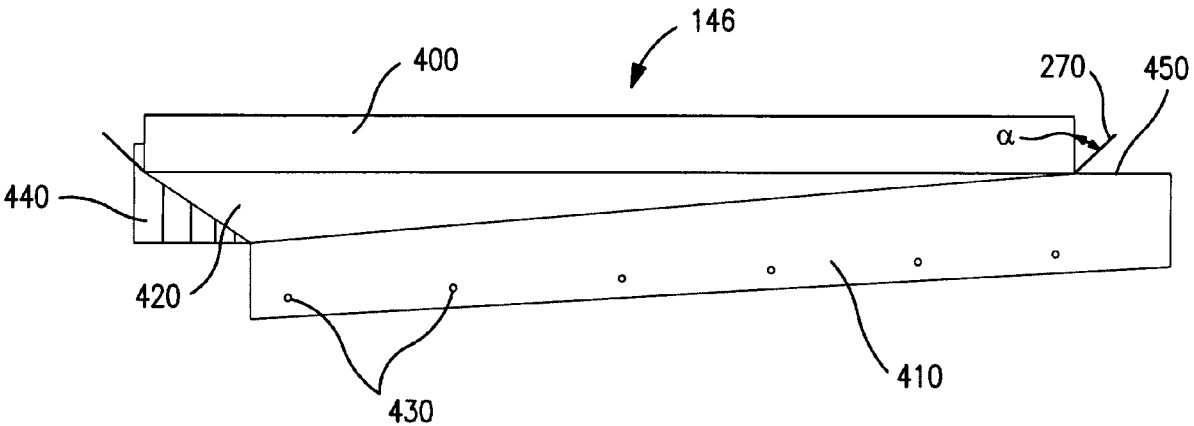
FIG. 11 is a top view of the upper rain pan or diverter of the rail and closure structure wherein the trailing closure flaps extend from of the ends of the intermediate end panel and define acute angles with upright sides of respective side rails, before the trailing closure flaps are closed over the upright sides of the side rails.
Figure 12:
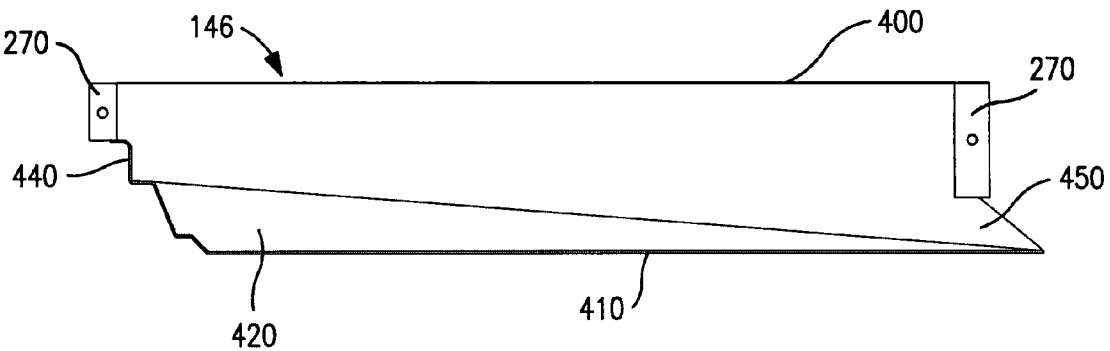
FIG. 12 is a front view of the upper rain pan or diverter of the rail and closure structure.

Looking now to FIGS. 10 through 12, an upper or high end diverter 146 provides end closure of the roof aperture at the upper end of the roof aperture, and diverts water around the upper end of the assembly, to the flat portion 114 of an adjacent panel. Diverter 146 also provides a weather tight seal at the upper end of the assembly, as used with support plate 148 (shown in FIG. 6) in combination with conventional sealant materials. In reference to side rails 142 and 144 of a standing seam panel roof 110, diverter 146 generally fits the profile of the uncut rib 112 across the panel flat from the cut away gap 122. The upper ends of side rails 142 and 144 abut the downstream side of diverter 146 and the height of diverter 146 closely matches the height of the side rails. Upper flange 400 of diverter 146 acts with upper flanges 240 of side rails 142 and 144 to form the upper surface of the rail and closure structure, to which the skylight lens frame is mounted, as well as surrounding a top aperture in the rail and closure structure, which overlies the corresponding aperture in the roof panel.

Lower flange 410 of diverter 146 runs along, and parallel to, panel flat 114 of the respective roof panel. Diverter 146 also has a diversion surface 420, and fastener holes 430 along lower flange 410. Diversion surface 420 is, without limitation, typically a flat surface defining first and second obtuse angles with lower flange 410 and intermediate end panel 415. Diversion surface 420 has relatively greater width "W1" on the side of the closure structure which is against the rib which is not cut, and a relatively lesser width "W2", approaching a nil dimension, adjacent rib gap 122, thus to divert water toward gap 122.

At the end of lower flange 410 which is closer to the closed rib is a rib mating surface 440. At the end of lower flange 410 which is closer to the cut rib is a rib sealing portion 450 of the end panel 415, which functions to divert water across the respective rib 112 and onto the flat portion of the adjacent roof panel. Rib sealing portion 450 extends through gap 122 in the respective rib at the panel flat elevation. Hard rubber rib plugs 460, along with suitable tape mastic and caulk sealants, are inserted into the cut ends of the rib on both the upstream side and the downstream side of the rib at gap 122. The cross-section profiles of plugs 460 approximate the cross-section profiles of the cavities inside the respective rib 32. Thus plugs 460, when coated with tape mastic and tube caulk, provide a water-tight closure in the upstream side of the cut rib, and a back-up water-tight closure in the downstream side of the cut rib. Diverter flange 215 provides the primary closure at the cut end of the rib on the downstream side of gap 122. Accordingly, water which approaches the high end diverter is diverted by diversion surface 420 and flange 410 toward sealing portion 450, thence through the gap 122 in the rib, away from the high end of load support structure 100 and onto the flat portion of the next laterally adjacent roof panel.

FIGS. 10 and 11 further show diverter ears 270 on opposing ends of the upper diverter. Ear 270 is shown, in top view, at an angle $\alpha$ of about 45 degrees to the end of the diverter. FIG. 10 shows an ear 270 after the upper diverter has been assembled to a rail, and the ear has been bent flat against the respective outer rail panel.

Figure 13:
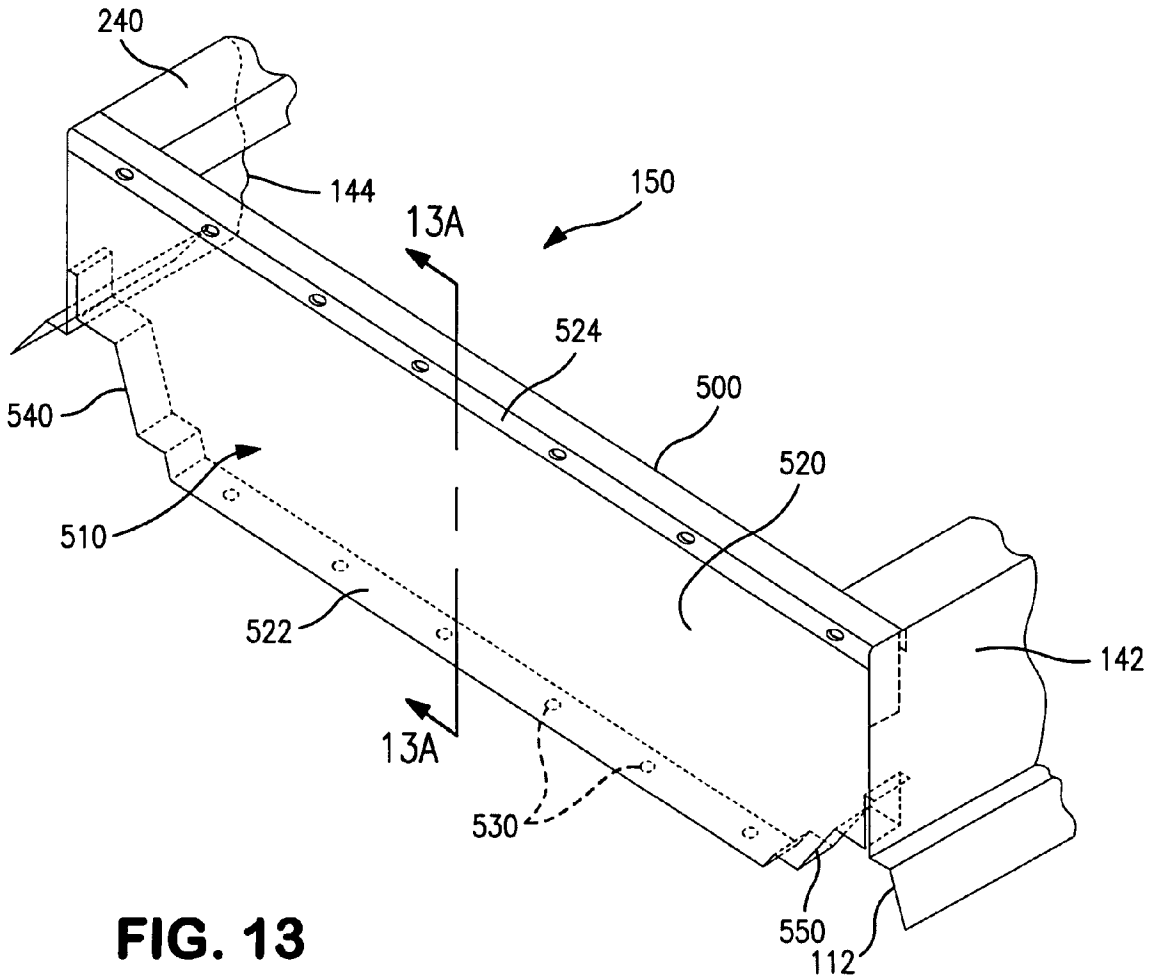
FIG. 13 is a perspective view of the lower end roof panel profile closure or lower closure of the rail and closure structure.
Figure 14:
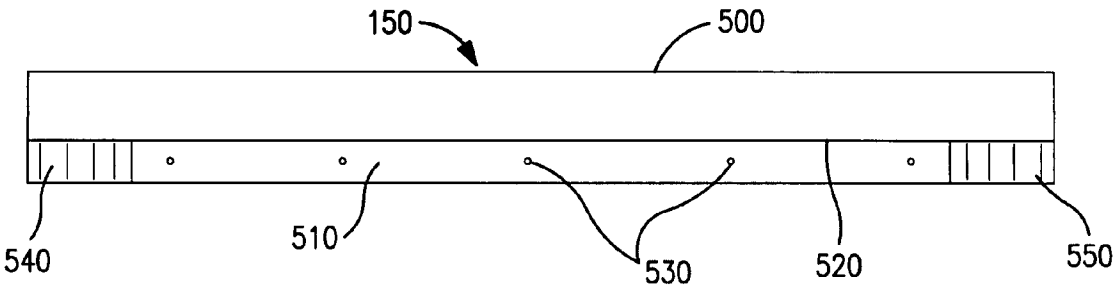
FIG. 14 is a top view of the lower end roof panel profile closure, or lower closure, of the rail and closure structure.
Figure 15:
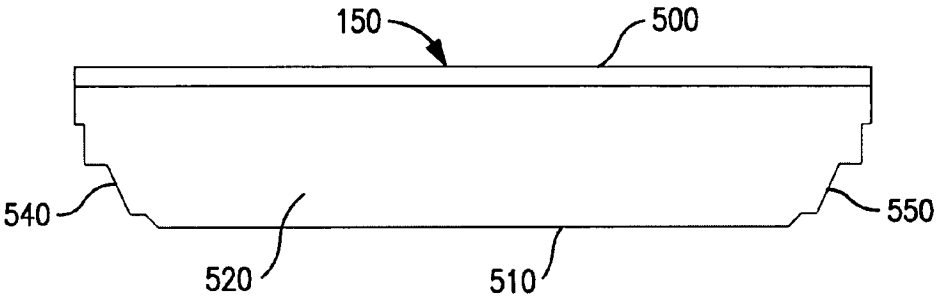
FIG. 15 is a front plan view of the lower end roof panel profile closure or lower closure of the rail and closure structure.

FIGS. 13 through 15 show the lower end roof panel profile closure 150 which is used to maintain a weather tight seal at the lower end of rail and closure structure 140. Shown again in reference to side rails 142 and 144 of a standing seam panel roof 110, the bottom of closure 150 is contoured to fit the profiles of the ribs 112 as well as to fit the contour of panel flat 114. Side rails 142 and 144 abut bottom closure 150 and the height of closure 150 matches the heights of side rails 142, 144.

Figure 13A:
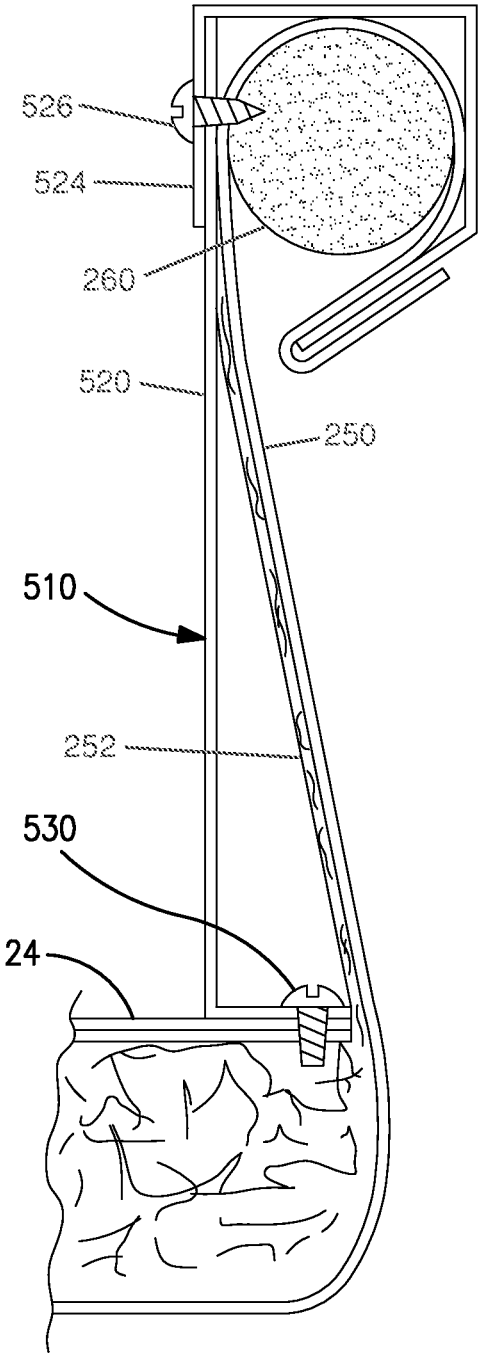
FIG. 13A is a cross-section taken at 13A-13A of FIG. 13, showing the relationships between the bottom portion of the lower closure and the overlying flange, showing the insulation facing sheet being held in the flange cavity by the foam retainer rod, with the screws which mount the overlying flange to the bottom portion being embedded in the thermally insulating foam retainer rod, and showing a reinforcing plate under the flat of the metal roof panel whereby the joint between the bottom flange of the bottom portion of the lower closure and the flat of the roof panel is supported by the reinforcing plate.

Comparing FIGS. 8D and 13A, FIG. 13A shows layer 256 of batt insulation material drawn up into the aperture between the insulation facing sheet and the upstanding closure web 520 of the lower closure.

Lower closure 150 has a bottom portion 510 and an upper rail 500. Bottom portion 510 has a lower flange 522, as well as a closure web 520. Lower flange 522 is in-turned, extends inwardly of closure web 520, and includes fastener holes 530. Upper rail 500 is an inverted U-shape structure. A first downwardly-extending leg 524 has a series of apertures, and screws 526 or other fasteners which extend through leg 524 through closure web 520, through facing sheet 250, and terminating in rod 260, thus mounting rail 500 to bottom portion 510. Upper rail 500 extends from closure web 520 inwardly of closure web 520 at a common elevation with bearing panels 240 of the rails. Collectively, the top flanges of side rails 142, 144, bottom closure 150, and high end diverter 146 form a common top surface of the rail and closure structure, which receives the skylight lens subassembly.

Closure 150 includes rib mating flanges 540 and 550 to provide tight fits along ribs 112.

Figure 16:
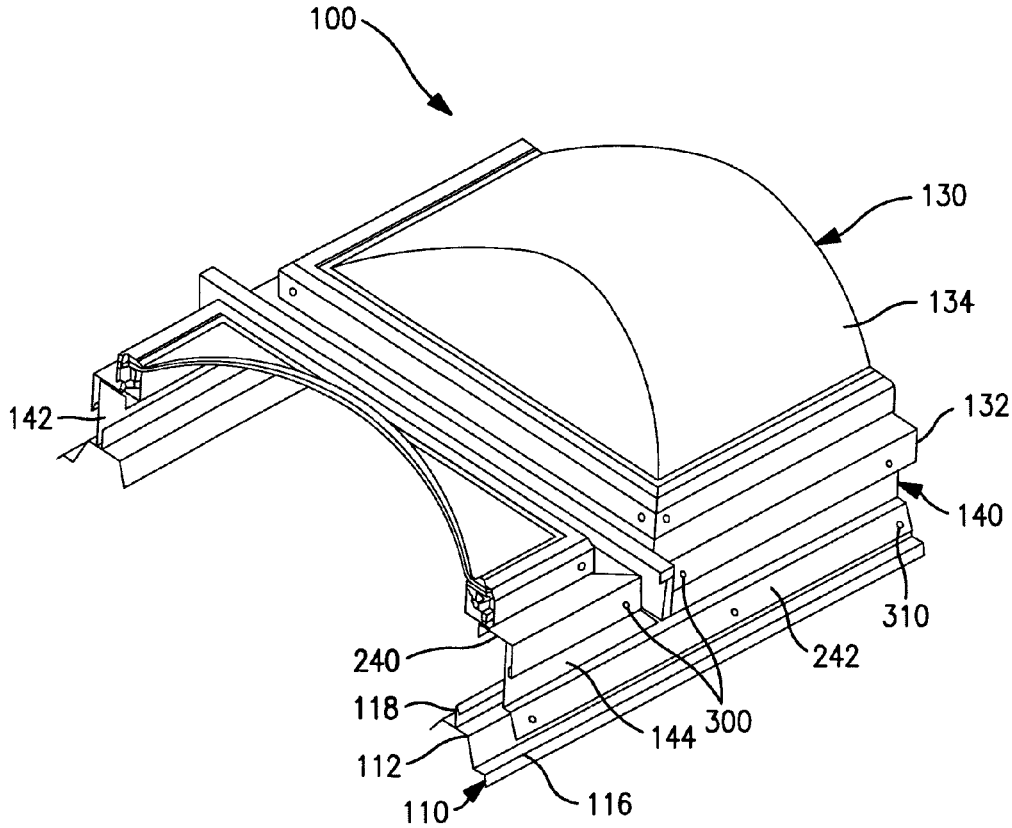
FIG. 16 is a perspective and partially cut away view showing a connection of adjacent skylights of the system.
Figure 17:
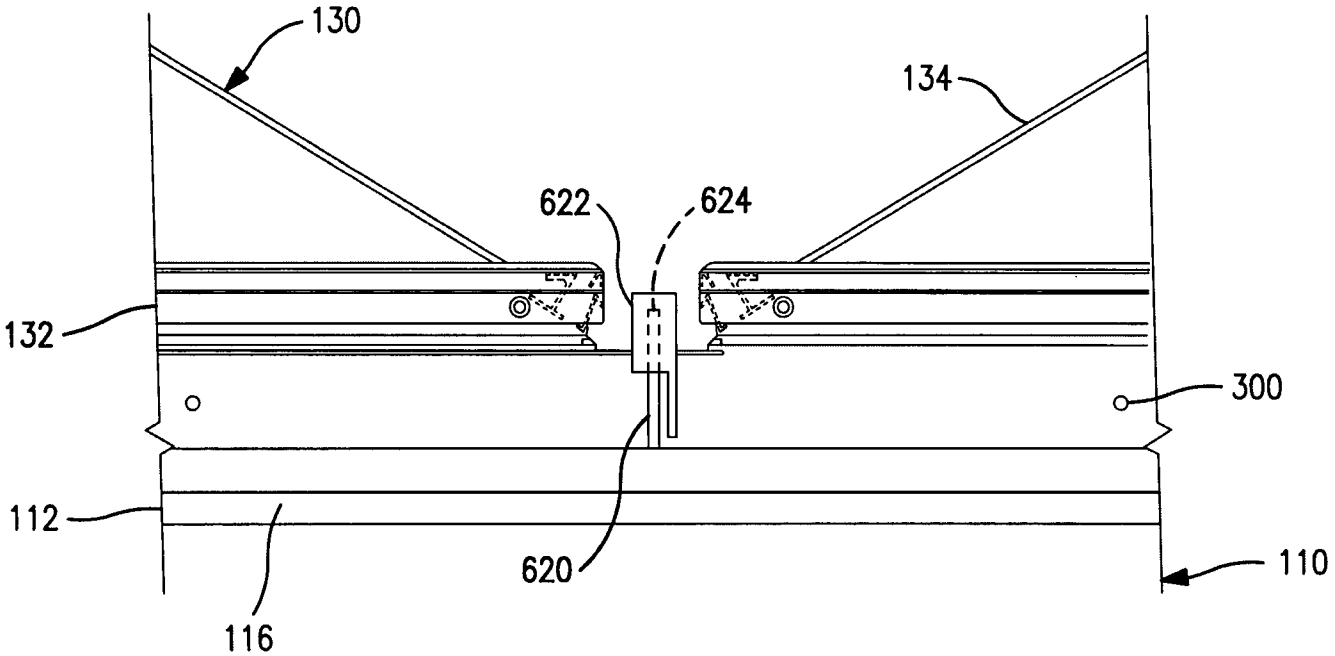
FIG. 17 shows additional detail of how the adjacent skylight ends are joined to each other.

Looking now to FIGS. 16 and 17, the adaptation of load support structures 100 of the invention for supporting multiple skylight units over a single aperture in the roof, is shown. A chief aspect of load support structures 100 is the reduction in the number of roof penetrations, namely roof apertures, required to provide daylight lighting to the interior of e.g. a building, as multiple skylight assemblies can be mounted along the length of a single elongate aperture in the roof, whereby fewer, though longer, apertures can be made in the roof. Namely, a single opening in the roof can extend along substantially the full length of a single rib, if desired, rather than cutting multiple smaller openings along that same length, and thereby providing for an equal or greater quantity of ambient light being brought into the building through a smaller number of roof apertures.

Figure 18:
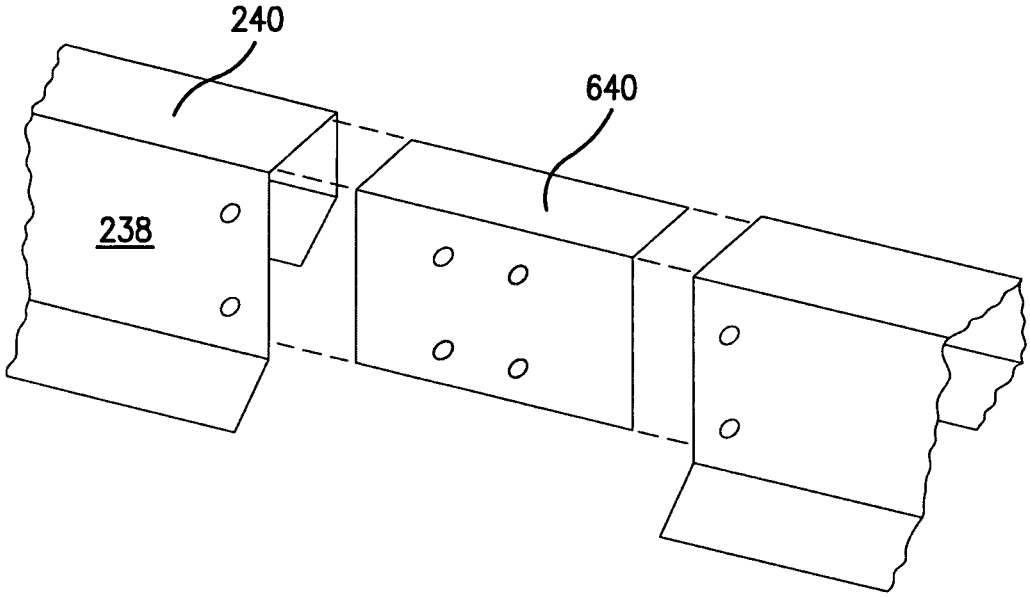
FIG. 18 shows an exploded pictorial view of a rail connector aligned with abutting rail ends and wherein the connector bridges the butt joint between the rails, thus providing both reinforcement of the joint and enhanced seal of the joint against intrusion of water.

FIG. 18 shows an exploded pictorial view of the ends of first and second rails in abutting relationship, such as where first and second skylights are arranged in end-to-end relationship over a common roof aperture. Connector 640 is configured to fit closely inside the cavity cross-sections defined by the respective rails, against the outer rail panels 238 and against the rail bearing panels 240. Connector 640 is shown aligned with the abutting rail ends. The connector is inserted into the cavities in the rails, bridging the butt joint between the rails. Apertures 644 in the connector align with apertures 646 in the rails when the ends of the rails are in closely abutting relationship. Screws or other known aperture-to-aperture fasteners are used to securely fasten connector 640 to both of the rails. Tape mastic and tube caulk are used, as known in the art for water seal closures, to fill the joint between the rail panels and the reinforcing connector. Connector thus provides both reinforcement of the joint and enhanced seal of the joint against intrusion of water.

In the case of standing seam roofs, the load support structures of the invention provide the ability to remove only a portion of the bottom flat portion of a given metal roof panel. This maintains the structural integrity of the roof panel by avoiding removal of multiple sections of major panel elevations in adjacent roof panels, as is done to accommodate a "conventional" curb assembly which spans multiple roofing panels. Thus, the structural integrity of the roof, as defined by the roof panels, is not as greatly compromised and there are fewer potential openings for water infiltration, in that the upper reaches of the skylight panels can be mounted in the roof adjacent the ridge of the building and can extend to the eave, requiring water to be diverted only once near the ridge of the roof plane and only across one panel flat.

To the limited extent that gaps are cut in the elevations/ribs, such gaps extend only a minimal length of the respective ribs, on the order of a few inches or less, solely for the purpose of allowing drainage around the upper ends of the rail and closure structures.

The rails, with or without the high end diverter or the lower closure, depending on the presence, or not, of an aperture in the roof, can be installed on major rib elevations for any of the aforementioned roof panel profiles relative to the included flat portion of the respective roofing panel, so long as the rib structure can adequately support the contemplated load.

The load support structures of the invention are particularly useful for continuous runs of e.g. skylights, where individual skylights are arranged end to end between the ridge and the eave of a roof. FIGS. 16 and 17 show how two adjacent skylight assemblies 100 can be affixed to each other along a standing seam roof 110. Instead of installing a high end diverter and a lower closure with each of multiple skylight assemblies, the adjacent rail and closure structures, which support adjacent ones of the skylight assemblies, abut each other. Each skylight assembly has a male flange 620 extending across the width of the skylight assembly at one end of the assembly and a female flange 622 at the opposing end of the assembly. For runs of multiple skylight assemblies, disposed end to end as illustrated in FIGS. 16 and 17, female flange 622 is mounted over male flange 620, whereby male flange 620 is received inside cavity 624 of the female flange. Caulk or other sealant can be used to seal such closure/cavity.

As a non-limiting example, skylights can be produced in units of up to 10 feet long, and connected end to end for as long a distance as necessary to cover the aperture in the roof, as each skylight unit is supported by the ribs 112 of the respective roof panel. The standing rib elevation (the major corrugation) extends longitudinally along the full collective lengths of the sides/rails of the respective rail and closure assemblies 140, regardless of the number of skylight assemblies which are used to close off a given aperture in the roof. Water cannot enter over the top of the rail and closure assembly because of the sealant at 330. Water cannot enter at the high end diverter because of the seal properties provided by the high end diverter, by bearing plate 148, and by the respective sealants, as well as because of the diversion of water away from the high end through gap 122. Similarly, water cannot enter at the lower end because of the seal properties provided by the lower closure and by the sealants between the lower closure and the respective roof panel. Where the skylight assembly starts at the ridge of the roof, a flashing can be inserted under the ridge cap and extended to the high end diverter.

Where the ridge cap has a configuration to fit the rib elevations (major corrugation) in the roofing panels, a portion of the rib, in the ridge cap, may be cut out (approximately 2 inches as in all rib cutting discussed elsewhere herein), allowing the water from the roof above the cut to be diverted laterally, sideways onto the next adjacent roof panel, as across sealing portion 450 and thus across the rib.

If desired, side-by-side rails 142, 144 can be increased in height to increase the distance/height between an upper portion of the rail and closure structure and the respective underlying roof panel. In the alternative, a height extension rail can be laid over or attached to the top of the rail and closure structure to provide a corresponding height increase. Such an extension can be produced to rest along the upper flange of the rail and closure assembly, to effectively raise the height of the skylight or smoke vent to accommodate different depths or other design features of the respective skylights, smoke vents, or other roof loads, or to accommodate snow conditions, anticipated snow depths, and the like. In this fashion, the rail and closure structure can be produced to a standard height, with varying extensions used to elevate the overall height of the structure for such varied purposes. Various forms for such an extension can be suitable, and the skilled artisan will understand various ways and means of designing and manufacturing such extension to accomplish the goal of added elevation for the skylight lens.

As indicated above, the weight of the loads transferred by rails 142, 144 is transferred directly to ribs 112 of the respective underlying roof panels along the full lengths of the load support structures; and only a minor portion of that weight is borne by the panel flat, and only at the high end and at the lower end of a load which overlies an aperture in the roof, and wherein such aperture can underlie e.g. multiple skylight units. Thus, the weight of the rails, or the rail and closure assembly, is borne by the strongest elements of the roof panels. Specifically because the weight is borne directly by the panel ribs, a wide variety of roof-mounted loads, in addition to skylights and smoke vents, is contemplated to be mounted on rails 142, 144. Where the load overlies an aperture in the roof, the rail system provides for fewer apertures. Where the load does not overlie an aperture in the roof, the rail system allows the roof to carry the weights of a variety of loads without penetrating the roof for the purpose of extending the support path through openings in the roof to the underlying building structural members, also without adding framing or other bracing under the roof panels to support the weight of such roof-mounted hardware, and thus avoiding water leaks associated with such openings, so long as the weight of such roof-mounted loads do not exceed the allowable load on the ribs. And where a roof-mounted load is e.g. an air conditioner, namely a load which does not require a roof opening, the high end diverter and the lower end closure can be omitted.

The primary reason why the disclosed rail and closure structures do not leak is that a great portion of the perimeter of the closure, namely that which is defined by side rails 142, 144, is above the panel flat, namely above the water lines on the roof panels. With no standing water at the joints between the rails and the roof panels, even if the sealant fails at the joint, the heights of those joints above the water line means that no water routinely enters such failed joint.

As a general statement, rail and closure structures of the invention close off the roof aperture from unplanned leakage of e.g. air or water through the roof aperture. The rail and closure structure 140 extends about the perimeter/sides of the roof aperture and extends from the roofing panel upwardly to the top opening in the rail and closure structure. The lens subassembly overlies the top opening in the rail and closure structure and thus closes off the top opening to complete the closure of the roof aperture.

Load support structure 100 thus is defined by rail and closure structure 140 about the perimeter of the roof opening and by skylight lens subassembly 130, or the like, over the top of the rail closure structure and thus over the top of the roof aperture.

Although the invention has been described with respect to various embodiments, this invention is also capable of a wide variety of further and other embodiments within the spirit and scope of the appended claims.

Those skilled in the art will now see that certain modifications can be made to the apparatus and methods herein disclosed with respect to the illustrated embodiments, without departing from the spirit of the instant invention. And while the invention has been described above with respect to the preferred embodiments, it will be understood that the invention is adapted to numerous rearrangements, modifications, and alterations, and all such arrangements, modifications, and alterations are intended to be within the scope of the appended claims.

To the extent the following claims use means plus function language, it is not meant to include there, or in the instant specification, anything not structurally equivalent to what is shown in the embodiments disclosed in the specification.

Having thus described the invention, what is claimed is:

1. A sloped metal roof on a building, said metal roof comprising a plurality of roof panels, having lengths and widths, panel flats extending across such panel widths, said roof panels being arranged side by side, edges of adjacent said roof panels meeting and being joined to each other at elevated rib structure portions thereof and thereby defining ribs between the panel flats of adjacent said roof panels, a roof adaptive system being assembled to said roof, said roof adaptive system comprising:

(a) an aperture extending through said roof, and defining a passage between an interior of such building and an ambient environment outside such building;

(b) a rail and closure structure having an upper end and a lower end and comprising a plurality of closures mounted on said roof about such aperture, and a closure member overlying said closures, said rail and closure structure having an inner surface and an outer surface, and separating a surrounded space, over such aperture, from the ambient environment; and (c) insulation disposed under, and proximate, said metal roof at and proximate the aperture, an upstanding portion of said insulation extending up through the aperture, between the surrounded space and said closures closure, and being captured in one or more cavities at said closures, between walls of the one or more cavities and retaining rod elements in the one or more cavities.

2. A metal roof as in claim 1, said rail and closure structure comprising first and second elongate rails mounted to respective first and second said ribs on opposing sides of a said panel flat.

3. A metal roof as in claim 1, said closure member comprising a skylight lens assembly, mounted to said rail and closure structure at multiple locations about said rail and closure structure.

4. A metal roof as in claim 1 wherein said closure member comprises an operable vent which can be alternatively closed and opened to the outside environment.

5. A metal roof as in claim 1, said closure structure comprising first and second elongate rails on opposing sides of the aperture, wherein said first and second rails are mounted to respective first and second ones of said ribs on opposing sides of a such panel flat, and wherein said rails are spaced above respective ones of such panel flats which are adjacent the respective said ribs.

6. A metal roof as in claim 1, the aperture being confined to the panel flat of a single said roof panel, and said rail and closure structure comprising first and second rails mounted to next adjacent ones of said ribs on opposing sides of the aperture such that said rail and closure structure extends across the flat of a single said roof panel and onto said next adjacent ribs.

7. A metal roof as in claim 1, said insulation comprising a thermally insulating layer and a facing sheet, further comprising an upstanding portion of said thermally insulating layer extending up into the aperture between said closure members and the facing sheet.

8. A metal roof as in claim 1, said closure structure comprising an upper diverter, said upper diverter comprising a lower flange, an end panel, and a diversion surface between said lower flange and said end panel, the diversion surface defining first and second obtuse angles with said lower flange and said end panel.

9. A metal roof as in claim 8 wherein the diversion surface has an upper edge and a lower edge, and a relatively greater width between the upper and lower edges on a first side of said closure structure and a relatively lesser width between the upper and lower edges on a second side of said closure structure.

10. A metal roof as in claim 9, further comprising a gap extending across a said rib adjacent a said panel flat at, and extending away from, the upper end of said closure structure, and wherein the lower edge of the diversion surface extends at a downward slope from a first side of said closure structure toward the gap.

11. A building comprising a metal roof as in claim 1.

12. A sloping metal roof system on a building, said metal roof system comprising:

(a) a plurality of roof panels arranged side by side, said roof panels having lengths and widths, adjacent ones of said roof panels meeting at elevated rib structure portions thereof, the elevated rib structure portions on a first said roof panel being joined with the elevated rib structure portions on adjacent said roof panels to form first and second elevated ribs at such joinders, said roof panels further comprising panel flat portions between said elevated rib structure portions; and (b) a roof adaptive system, comprising (i) an aperture extending through said roof, (ii) a load support structure extending about the aperture, said load support structure comprising A. as a first side rail structure, a first side rail mounted to a first one of said ribs and extending in a first direction, and a second side rail mounted to said first one of said ribs and extending in the first direction, the first and second side rails cooperating in defining a first side of said load support structure, B. as a second side rail structure, a third side rail mounted to a second one of said ribs and extending in a second direction, and a fourth side rail mounted to said second one of said ribs and extending in the second direction, the third and fourth side rails cooperating in defining a second side of said load support structure, C. a first end closure extending away from said first side rail and toward said third side rail at an upper end of said load support structure, and D. a second end closure extending away from said second side rail and toward said fourth side rail at a lower end of said load support structure, the combination of said first and second side rails, said third and fourth side rails, and said first and second end closures, collectively defining an opening through such load support structure above, and aligned with, such aperture.

13. A sloping metal roof as in claim 12, further comprising a gap, having a width extending in a direction along to the lengths of the respective said roof panels, such gap extending across said second rib at the upper end of said load support structure adjacent such panel flat at, and extending away from, the upper end of said load support structure, and at an elevation of the respective panel flat.

14. A sloping metal roof as in claim 12, further comprising a gap cut through, and extending across, a said elevated rib, said first end closure comprising a diverter in the gap, diverting water laterally away from the end of the aperture and onto an adjacent said roof panel.

15. A sloping metal roof as in claim 12, further comprising a first connector securely fastened to said first and second rails, and extending across a first joint between said first and second rails, and a second connector securely fastened to said third and fourth rails, and extending across a second joint between said third and fourth rails.

16. A sloping metal roof as in claim 12 wherein the aperture is confined to the panel flat of a single said roof panel.

17. A sloping metal roof as in claim 12, said rails being above, and spaced from, respective panel flats of said roof panels to which said rails are mounted.

18. A sloping metal roof as in claim 12, said first end closure comprising a lower flange, an end panel, and a diversion surface between said lower flange and said end panel, the diversion surface defining first and second obtuse angles with said lower flange and said end panel.

19. A sloping metal roof as in claim 18 wherein the diversion surface has an upper edge and a lower edge, and a relatively greater width between the upper and lower edges on a first side of said load support structure and a relatively lesser width between the upper and lower edges on a second side of said load support structure.

20. A sloping metal roof as in claim 19, further comprising a gap extending across a said rib adjacent a said panel flat at, and extending away from, the upper end of said closure structure, and wherein the lower edge of the diversion surface extends at a downward slope from a first side of said load support structure toward the gap.

21. A building comprising a metal roof as in claim 12.

22. A sloping metal roof system on a building, said metal roof system comprising (a) a metal roof comprising a plurality of metal roof panels, having lengths and widths, panel flats extending across the panel widths, said roof panels being arranged side by side, edges of adjacent said roof panels meeting at elevated rib structure portions thereof and thereby defining ribs between panel flats of adjacent said roof panels; and (b) a roof adaptive system being assembled to said roof, said roof adaptive system comprising (i) an aperture extending through said metal roof, and defining a passage between an enclosed space inside such building and an ambient environment outside such building, and (ii) a load support structure comprising a plurality of closures mounted on said roof about the aperture, and a closure member overlying said closures, said load support structure having an inner surface and an outer surface, and separating a surrounded space, over such aperture, from the ambient environment, one or more cavities at the inner surfaces of said closures, defining a cavity path extending about the inner surface of said load support structure, and a rod in the one or more cavities and extending along the cavity path, said closure member being mounted to said closures by a plurality of fasteners, said fasteners terminating in said rod.

23. A sloping metal roof system as in claim 22, said load support structure comprising first and second elongate side rails mounted to respective first and second said ribs on opposing sides of a said panel flat.

24. A sloping metal roof system as in claim 23, said rails being above, and spaced from, respective panel flats of said roof panels to which said rails are mounted.

25. A sloping metal roof system as in claim 22, said closure member comprising a skylight lens assembly.

26. A sloping metal roof system as in claim 22, said load support structure overlying the panel flat of a single said roof panel.

27. A sloping metal roof system on a building, said metal roof system comprising (a) a metal roof comprising a plurality of metal roof panels, having lengths and widths, panel flats extending across the panel widths, said roof panels being arranged side by side, edges of adjacent said roof panels meeting at elevated rib structure portions thereof and thereby defining ribs between panel flats of adjacent said roof panels; and (b) a roof adaptive system being assembled to said roof, said roof adaptive system comprising (i) an aperture extending through said metal roof, and (ii) a load support structure mounted on said roof about the aperture, said load support structure comprising a plurality of closures, including first and second side rails, an upper diverter at an upper end of said load support structure, and a lower closure at a lower end of the load support structure, said load support structure having an inner surface and an outer surface, and separating a surrounded space, over such aperture, from an ambient environment outside such building, one or more cavities at the inner surfaces of said closures defining a cavity path extending about the inner surface of said load support structure, and a rod in one or more of the cavities and extending along the cavity path, including along the lower closure, said lower closure comprising a bottom portion and an upper rail, said upper rail being mounted to said bottom portion by a plurality of fasteners, said fasteners terminating in said rod.

28. A sloping metal roof system as in claim 27, said first and second side rails being mounted to respective first and second said ribs on opposing sides of a said panel flat.

29. A sloping metal roof system on a building, said metal roof system comprising (a) a metal roof comprising a plurality of metal roof panels arranged side by side, said roof panels having lengths and widths, adjacent first and second ones of said roof panels meeting at elevated rib structure portions thereof, the elevated rib structure portions on a first said roof panel being joined with the elevated rib structure portions on adjacent roof panels, with edge portions of the respective rib structures being folded over and thereby defining a folded-over edge, and thereby creating elevated ribs, having standing seams, at such joinders, said roof panels further comprising panel flats between said elevated rib structure portions; and (b) a roof adaptive system comprising (i) an aperture extending through said metal roof, and (ii) a load support structure extending about the aperture, said load support structure comprising A. first and second side rails mounted to respective first and second ones of said ribs, with a said panel flat between said first and second ribs, B. an upper diverter extending across said panel flat between said first and second ribs at an upper end of said load support structure, C. a lower closure extending across said panel flat between said first and second ribs at a lower end of said load support structure, and D. a gap extending across said second rib at the upper end of said load support structure adjacent such panel flat and said upper diverter, and extending away from the upper end of said load support structure.

30. A sloping metal roof system as in claim 29, further comprising a rib plug in a said rib at the gap.

31. A sloping metal roof system as in claim 29, further comprising a closure member overlying said load support structure.

32. A sloping metal roof system as in claim 29, said rails being spaced above the panel flats associated with the respective said ribs to which said rails are mounted.

33. A sloping metal roof system as in claim 29, at least one of said first and second side rails, in combination with an associated said standing seam, defining a standing seam gap, between an upstanding web of the respective said side rail, and the respective said standing seam, under the folded over edge, further comprising a gap plug in the standing seam gap between said upstanding web and said standing seam at the gap, under the folded-over edge.

* * * * *